US007951045B1

(12) United States Patent
Brader

(10) Patent No.: US 7,951,045 B1
(45) Date of Patent: May 31, 2011

(54) MULTI-FUNCTIONAL ATHLETIC TRAINING SYSTEM

(76) Inventor: Jason Brader, Center Valley, PA (US)

( * ) Notice: Subject to any disclaimer, the term of this patent is extended or adjusted under 35 U.S.C. 154(b) by 6 days.

(21) Appl. No.: 12/498,033

(22) Filed: Jul. 6, 2009

Related U.S. Application Data

(60) Provisional application No. 61/078,148, filed on Jul. 3, 2008.

(51) Int. Cl.
*A63B 71/00* (2006.01)

(52) U.S. Cl. ..... 482/3; 482/1; 482/8; 482/901; 434/247

(58) Field of Classification Search ..... 482/1–9, 482/87, 900–902; 434/247
See application file for complete search history.

(56) References Cited

U.S. PATENT DOCUMENTS

| | | | | |
|---|---|---|---|---|
| 4,408,183 | A | 10/1983 | Wills | |
| 4,627,620 | A | 12/1986 | Yang | |
| 4,645,458 | A | 2/1987 | Williams | |
| 4,702,475 | A * | 10/1987 | Elstein et al. | 273/445 |
| 4,728,100 | A | 3/1988 | Smith | |
| 4,751,642 | A | 6/1988 | Silva et al. | |
| 4,915,384 | A | 4/1990 | Bear | |
| 5,008,839 | A | 4/1991 | Goodwin et al. | |
| 5,221,243 | A | 6/1993 | Walker | |
| 5,290,043 | A | 3/1994 | Vidinic | |
| 5,574,669 | A | 11/1996 | Marshall | |
| 5,605,336 | A | 2/1997 | Gaoiran et al. | |
| 5,868,578 | A | 2/1999 | Baum | |
| 5,882,204 | A | 3/1999 | Iannazo et al. | |
| 5,888,179 | A | 3/1999 | Singhal | |
| 5,897,457 | A * | 4/1999 | Mackovjak | 482/8 |
| 5,901,961 | A | 5/1999 | Holland, III | |
| 5,988,861 | A | 11/1999 | Baum | |
| 6,042,492 | A | 3/2000 | Baum | |
| 6,073,489 | A | 6/2000 | French et al. | |
| 6,093,119 | A | 7/2000 | Tipton | |
| 6,371,931 | B1 | 4/2002 | Guillen | |
| 6,430,997 | B1 | 8/2002 | French et al. | |
| 6,585,622 | B1 | 7/2003 | Shum et al. | |
| 6,640,200 | B1 | 10/2003 | Baum | |
| 6,685,480 | B2 | 2/2004 | Nishimoto et al. | |
| 6,786,730 | B2 | 9/2004 | Bleckley et al. | |
| 6,918,845 | B2 | 7/2005 | Kudla | |
| 6,929,479 | B2 | 8/2005 | Bellows et al. | |
| 7,041,039 | B2 * | 5/2006 | Wang et al. | 482/87 |
| 7,309,234 | B2 * | 12/2007 | Mathog | 434/247 |
| 7,519,327 | B2 | 4/2009 | White | |
| 2003/0013584 | A1 | 1/2003 | Harney et al. | |
| 2003/0151554 | A1 | 8/2003 | McCarthy | |
| 2006/0247096 | A1 | 11/2006 | Raniere | |
| 2006/0281061 | A1 | 12/2006 | Hightower et al. | |
| 2007/0213126 | A1 * | 9/2007 | Deutsch et al. | 463/36 |
| 2007/0219059 | A1 | 9/2007 | Schwartz et al. | |

* cited by examiner

*Primary Examiner* — Glenn Richman
(74) *Attorney, Agent, or Firm* — Clinton H. Wilkinson, Esq.; Charles A. Wilkinson, Esq.

(57) ABSTRACT

A multi-functional athletic training system for automating many currently manually implemented tasks and performing reaction time, football receiver pattern, and shuttle/split training exercises, including one or more identical training domes, a touchpad unit, and a handheld control unit. In each mode of operation, different cue methods such as MANUAL VISUAL, MANUAL VISUAL & AUDIBLE, CADENCE and PAD may be selected to vary and train the athlete to respond to different starting cues.

18 Claims, 19 Drawing Sheets

RX
TX
MC
RAM
FLASH
LED Driver
IR TX
IR RX
SPLITS
+Vcc
+Vcc
196

MULTI-FUNCTIONAL ATHLETIC TRAINING SYSTEM

CROSS REFERENCE TO RELATED APPLICATIONS

This application claims the benefit of the filing date of U.S. provisional patent application Ser. No. 61/078,148, filed on Jul. 3, 2008, the disclosure of which is incorporated herein by reference.

BACKGROUND OF THE INVENTION

Field of the Invention

The present invention relates generally to sports performance and athletic training devices, and more particularly to devices for measuring and improving speed, agility, and reaction time.

Numerous training devices and tools for evaluating and improving athletic performance or general physical fitness, or to aid in practicing specific movements or skills, are known in the prior art. For example, mechanical stopwatches or digital timers are typically used to time athletes in completing a straight run, timed course or drill, or the like. However, other than calculating an overall performance time, such devices provide only a limited amount of pertinent feedback to the athlete that can be used to improve upon and optimize his or her performance, such as how the athlete reacts or responds to particular stimuli or audible and/or visual queues, or performance in different segments of a course or drill. In addition, known training aids optimized to test or improve performance of specific tasks or skills, such as required by a particular sport or activities, have limited usefulness and cannot be easily adapted or used to measure performance in other tasks or skills.

U.S. Pat. No. 4,408,183 issued to T. A. Wills on Oct. 4, 1983, entitled "Exercise Monitoring Device", discloses a device which enables users to compare the elapsed time in performing an exercise against a preselected pace or rate. A pickup transducer is used to detect a repetitive exercise action, and the performance is visually compared with the preselected rate on a display using a graph. The applicability of the Wills device is limited to those exercises that are repetitive in nature and confined to a small area within sensing distance of the transducer, such as performing deep knee-bends.

U.S. Pat. No. 4,645,458 issued to J. R. Williams on Feb. 24, 1987, entitled "Athletic Evaluation and Training Apparatus", discloses a method and device for measuring athletic performance, wherein an athlete proceeds from a starting point to a reaction point, at which one of a plurality of lamps is energized to indicate a predetermined action the athlete must accomplish upon reaching the reaction point, which time is then measured. Light beams are used to start the training scenario and indicate to the system by suitable detectors when the athlete has reached the reaction point, and a control unit is provided. The Williams training apparatus cannot carry out the variety of training scenarios available in the present inventor's system, which can be used to test reaction time to visual or audible stimuli, perform a large number of training patterns, and track split times in other training courses.

U.S. Pat. No. 4,627,620 issued to J. Yang on Dec. 9, 1986, entitled "Electronic Athlete Trainer for Improving Skills in Reflex, Speed and Accuracy", discloses a training apparatus that includes an electronic control having a timer and speed selection controls, and several target devices which are in communication with the electronic control. Each target device includes an LED light that is activated when a target is selected using the control, and a target ring which when hit by the player resets the target. In use, the targets are placed on the ground around the player, and the control device is operated to begin a sequence wherein the LED lights on the targets are randomly or sequentially activated. The player must rush to the lit target and hit the target ring in the fastest time possible, after which another target is lit and the player must hit the target ring on that target, and so on. Structurally, the targets are unlike the training domes of the present invention, and in addition, the Yang training device is not capable of performing the multiple training scenarios for which the present invention is designed.

Other systems for training and practicing sports-specific movements and improving reaction time are known, such as U.S. Pat. No. 4,702,475 issued to Elstein et al., wherein similar to what is shown in Williams an array of lights is placed in front of the athlete and programmed so that each light signifies a different movement pattern to be carried out. U.S. Pat. No. 4,728,100 issued to Smith discloses another exercise pacing device generally similar to the Wills device. U.S. Pat. No. 5,008,839 issued to Goodwin et al. discloses a portable sports training device for injecting real time speed into practice sessions, whereby skills must be successfully completed within a preset time simulative of actual game times in order for the athlete to get credit for completing the skill. U.S. Pat. No. 5,574,669 issued to Marshall discloses a foot pad sensor system for calculating foot movement speeds.

Various sports training systems including digital video cameras and video display images, such as U.S. Pat. No. 5,868,578 issued to Baum, U.S. Pat. No. 5,882,204 issued to Iannazo et al., and U.S. Pat. No. 6,042,492 are also known. These, in general allow an athlete's movements to be repetitively displayed for detailed study, often slowed down for better analysis.

U.S. Pat. No. 5,901,961 issued to Holland, III, discloses a system for measuring reaction time including a floor pad, several sensor pads, and a control device. The floor pad includes a pressure sensitive switch on which the user stands, and the sensor pads are provided in a box-like housing and include a light device. The sensor pads are spaced apart from the floor pad, and when a light on one of the pads is activated, the user leaves the floor pad and moves as quickly as possible to press the lighted sensor pad. Such device does not appear to be capable of performing a full "pattern" routine as is provided in the present inventor's device, however, and in addition cannot be used to measure split times or performance of other athletic activities.

U.S. Pat. No. 7,309,234 issued to D. Mathog discloses a sports cone having two rings of LED lights, one colored red and one colored blue. Depending upon the state of such lights, an athlete is instructed to pass the athlete on either the left, right, or either side of the cone, or not to pass at all, with the light signals being set at random.

The present inventor's athletic multi-functional training device and system is designed to improve an athlete's speed, reaction time, agility, and the efficiency and overall quality of a workout regimen. The multi-functional training device and system is a benefit to both coaches and athletes and may be used to improve training regimens and skills in virtually any sports activity. The present device is particularly applicable for use with timed drills, such as for tracking sprint speeds, sports specific movements, and hand-eye coordination. Athletes are required to react to a drill initiation cue, with may be auditory, visual, or auditory and visual, and the training device automatically calculates their time in completing such drill, whereby the end of the drill is completed when the user either passes through a laser sensor or hits a button to signal the end of the drill.

OBJECTS OF THE INVENTION

It is therefore a principal object of the present invention to provide an athletic training device and system for conducting athletic training drills and evaluating and improving training drill results, including reaction time drills, pattern exercises, and shuttle/split exercises.

It is a still further object of the present invention to provide a multi-functional training system for improving the training of athletes for both individual and team sports.

It is a still further object of the present invention to provide a multi-functional training system that automates many of the manually implemented tasks now being performed by coaches, and which system is portable and provides for multiple training exercises.

It is a further object of the invention to provide an athletic training device and system for determining and improving an athlete's reaction time, and in which mode multiple athletes can competitively train.

It is a further object of the invention to provide an athletic training device and system for conducting and improving performance of pattern exercises such as football receiver patterns.

It is a further object of the invention to provide an athletic training device and system for conducting and improving performance so-called in shuttle/split exercises.

It is a still further object of the invention to provide a training device that increases and maintains the interest and motivation of athletes during performance of training drills.

Still other objects and advantages of the invention will become clear upon review of the following detailed description in conjunction with the appended drawings.

SUMMARY OF THE INVENTION

The present invention is an improved multi-functional athletic training system designed to improve the training and performance of athletes in both individual and team sports, and in addition to automate many manually implemented tasks performance tasks now being individually performed by coaches. The improved training system is extremely versatile in that the system components are reconfigurable to accommodate different sport training activity modes such as reaction time exercises, football receiver pattern exercises, and so-called shuttle/split exercises, and allows multiple athletes to competitively train in active reaction mode. In addition, the system is provided in a compact portable package, and is comprised of and supplied in a preferred commercial embodiment of one or more identical training domes, a touchpad unit, and a handheld control unit. In one mode of operation, the touchpad unit emits an audible tone and infrared signal when activated, which signal is received by the handheld unit, which control unit emits an audible signal for the athlete to begin an exercise event. When the athlete releases the touchpad unit, the infrared signal ceases, and the handheld unit transmits a start timer signal to one of several training domes, and the athlete's reaction time thereto is measured. In another mode, a sequential pattern of activation of training domes can be selected, which pattern the athlete then repeats as quickly as possible. In yet another mode, the training domes, which include infrared emitters, are aligned in a straight line and corresponding infrared reflectors are positioned opposite and equidistant from the respective domes, forming a running lane. The reflectors are aligned with the infrared emitters so that the emitted signal is reflected back to a detector in the training domes, whereby when the athlete interrupts such signal a split time is recorded by each dome and transmitted to the handheld unit. Using the present inventor's multi-functional training system, a coach or fitness trainer can instruct athlete's to perform a variety of different training scenarios to improve reaction time, speed, agility, strength, and to practice specific exercises or patterns by providing useful and detailed feedback regarding each athlete's performance.

BRIEF DESCRIPTION OF THE APPENDED DRAWING

Figure 4A:
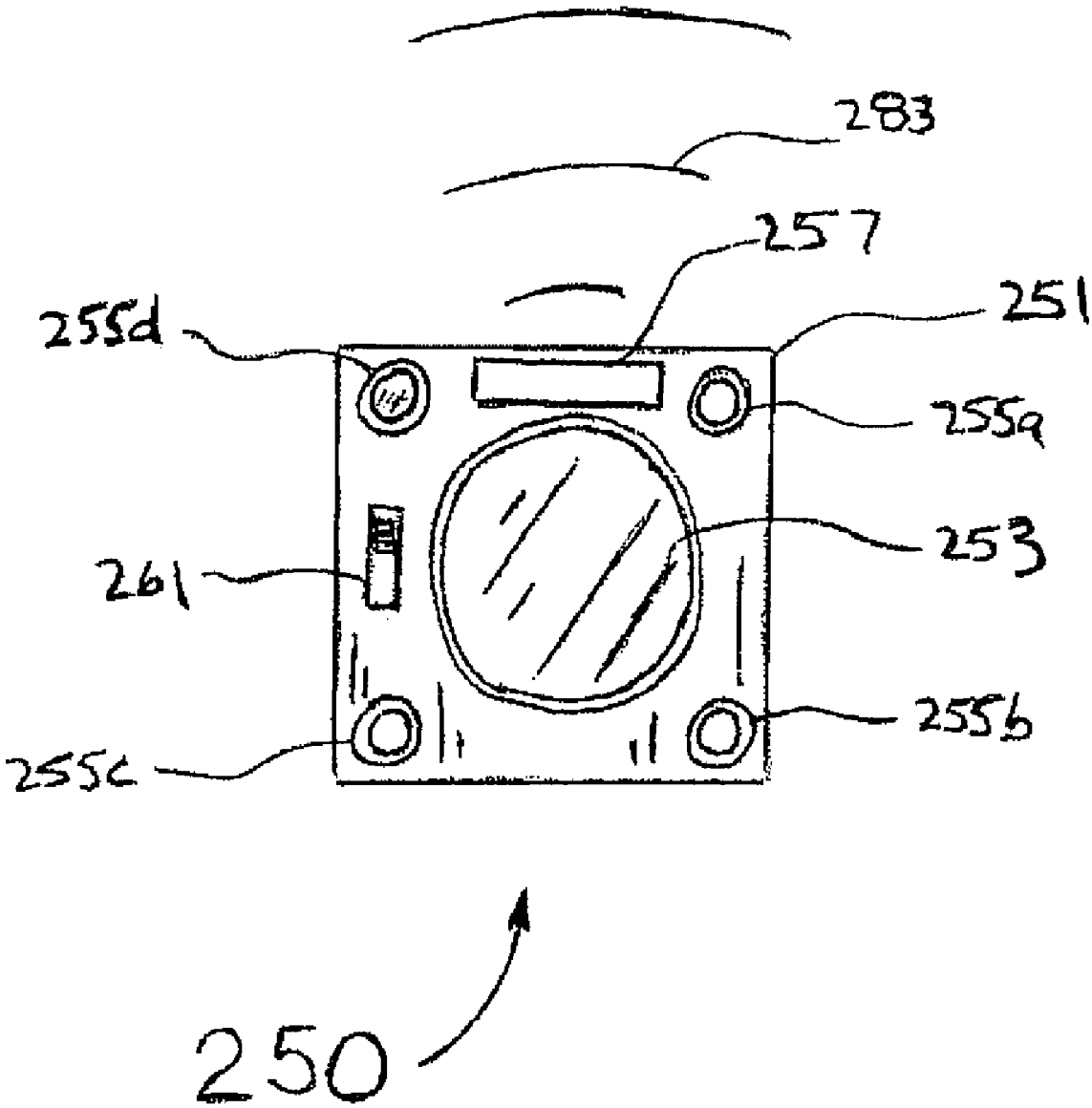

FIG. 4*a* illustrates a top view of the remote touchpad unit of the training system depicting the infrared transmitting module and on/off switch.

Figure 4B:
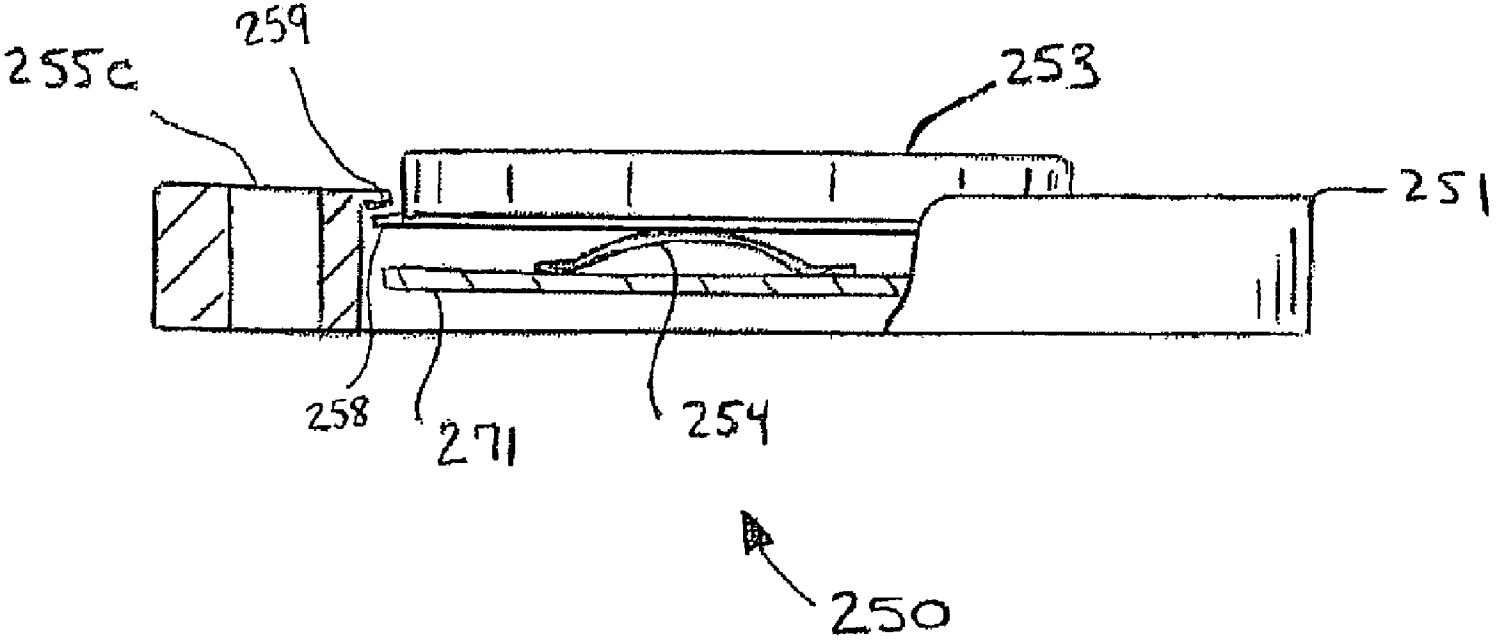

FIG. 4*b* illustrates a partially cut side away view of the remote touchpad unit.

Figure 5:
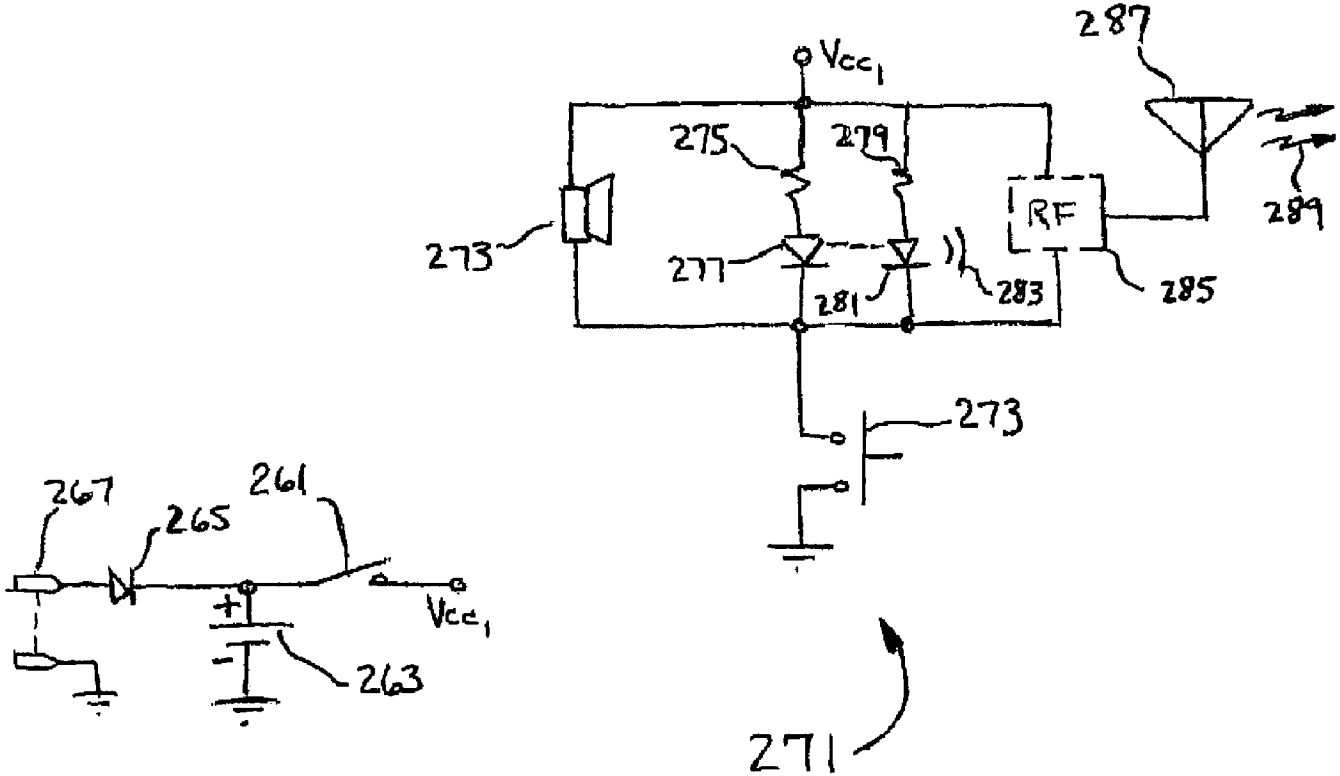

FIG. 5 shows the printed circuit board schematic of the touchpad unit.

Figure 6:
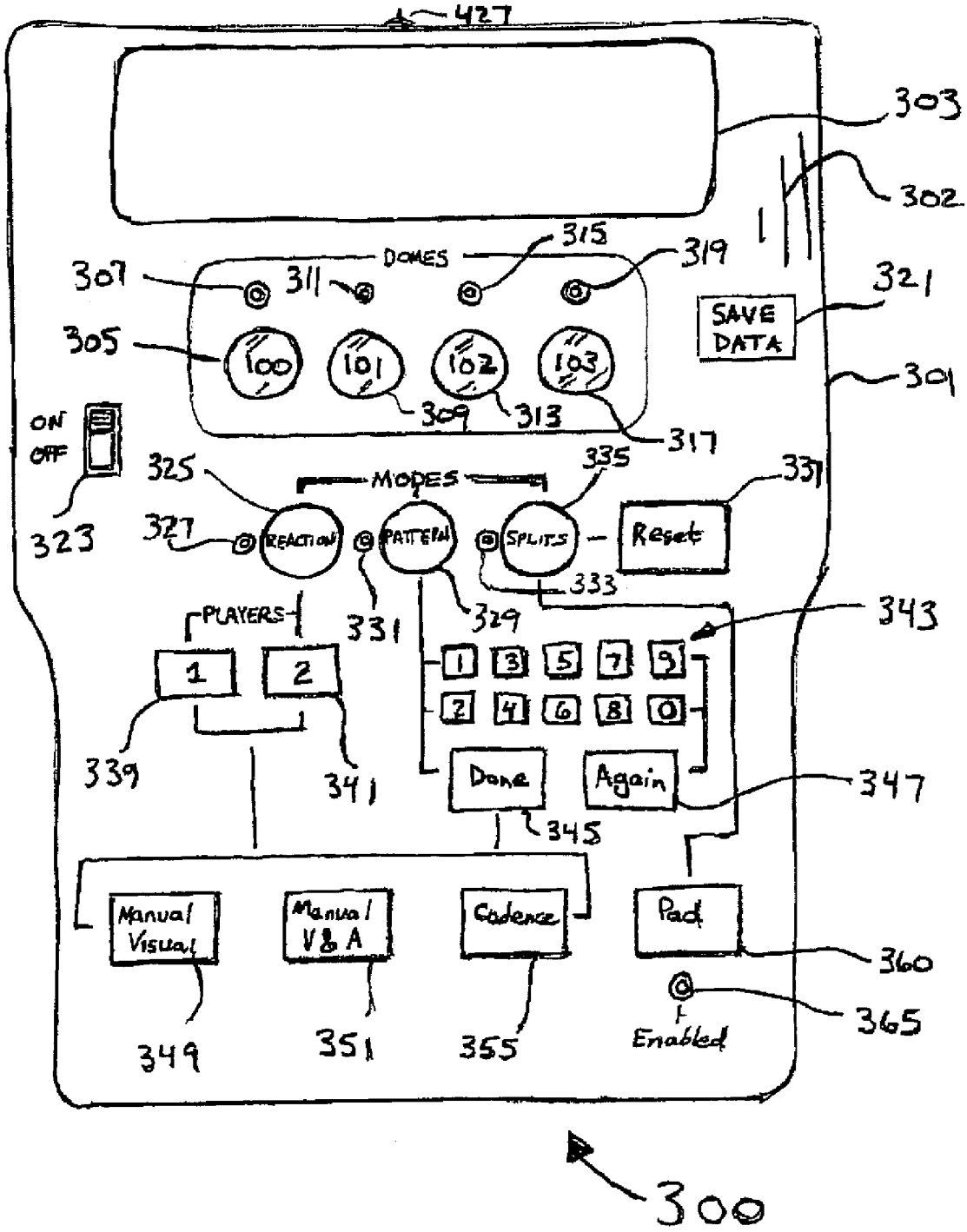

FIG. 6 illustrates the front panel of handheld unit 300.

Figure 7:
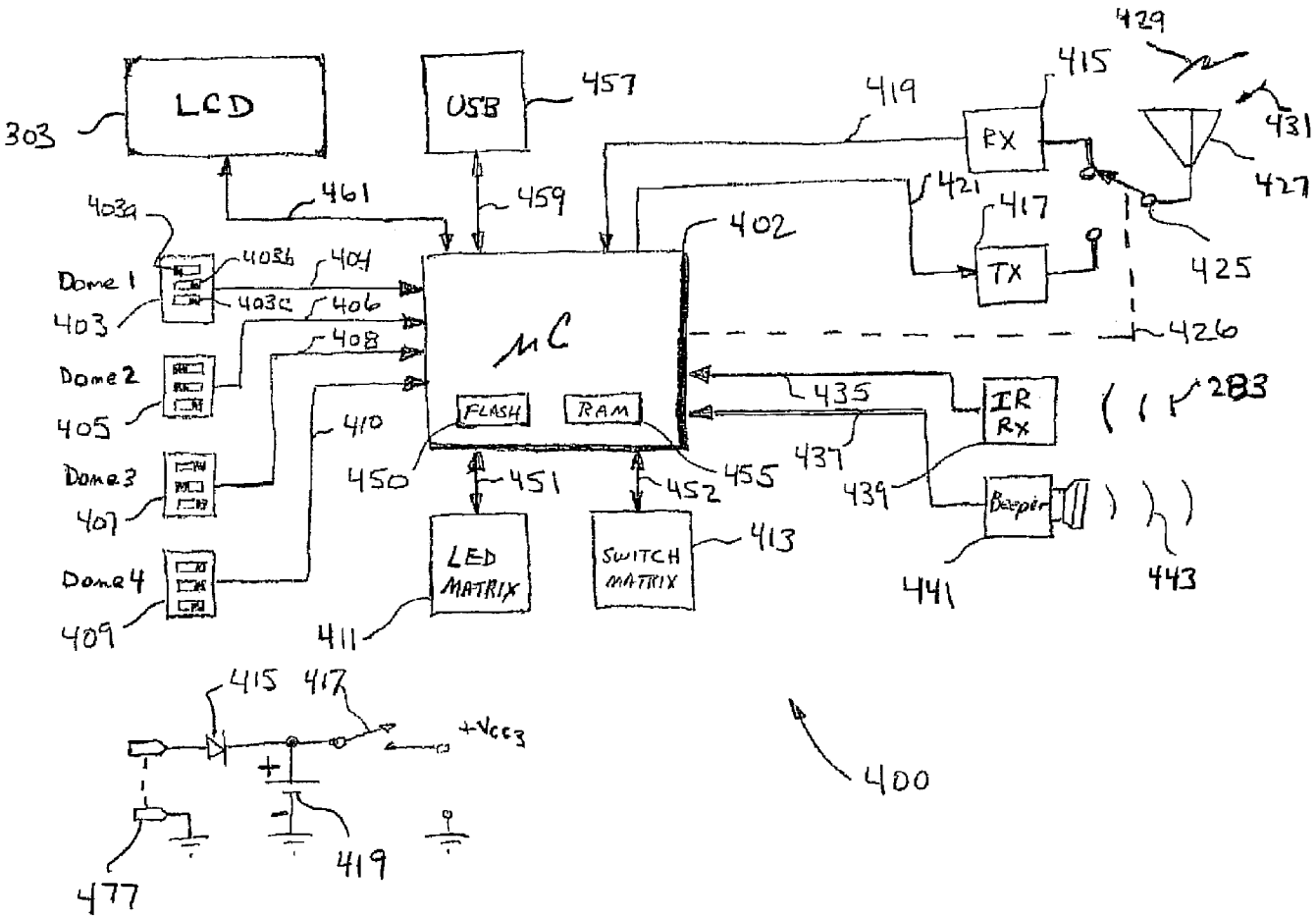

FIG. 7 shows the printed circuit board schematic of the handheld unit.

Figure 8:
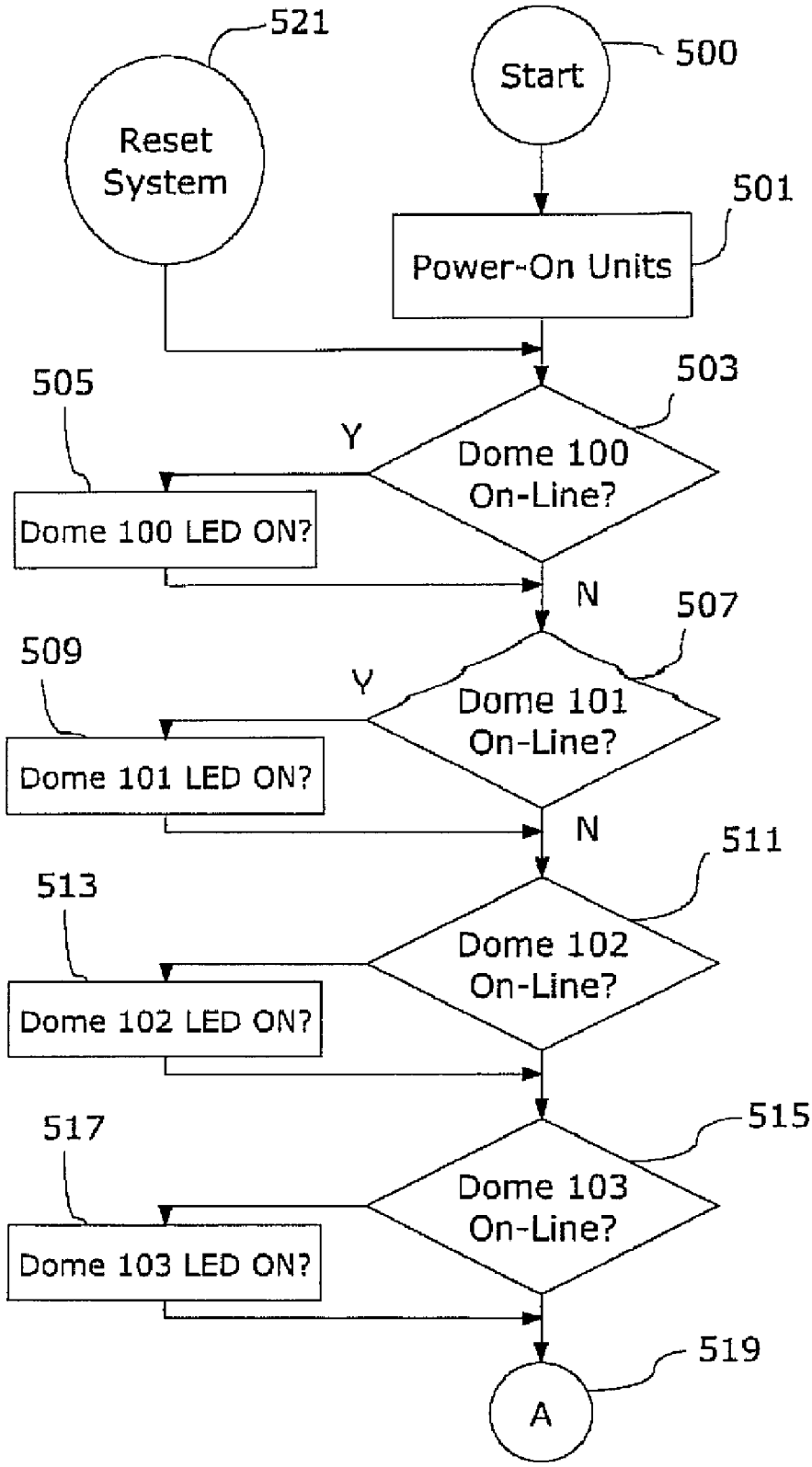

FIG. 8 shows the initialization flow chart of the handheld unit.

Figure 9:
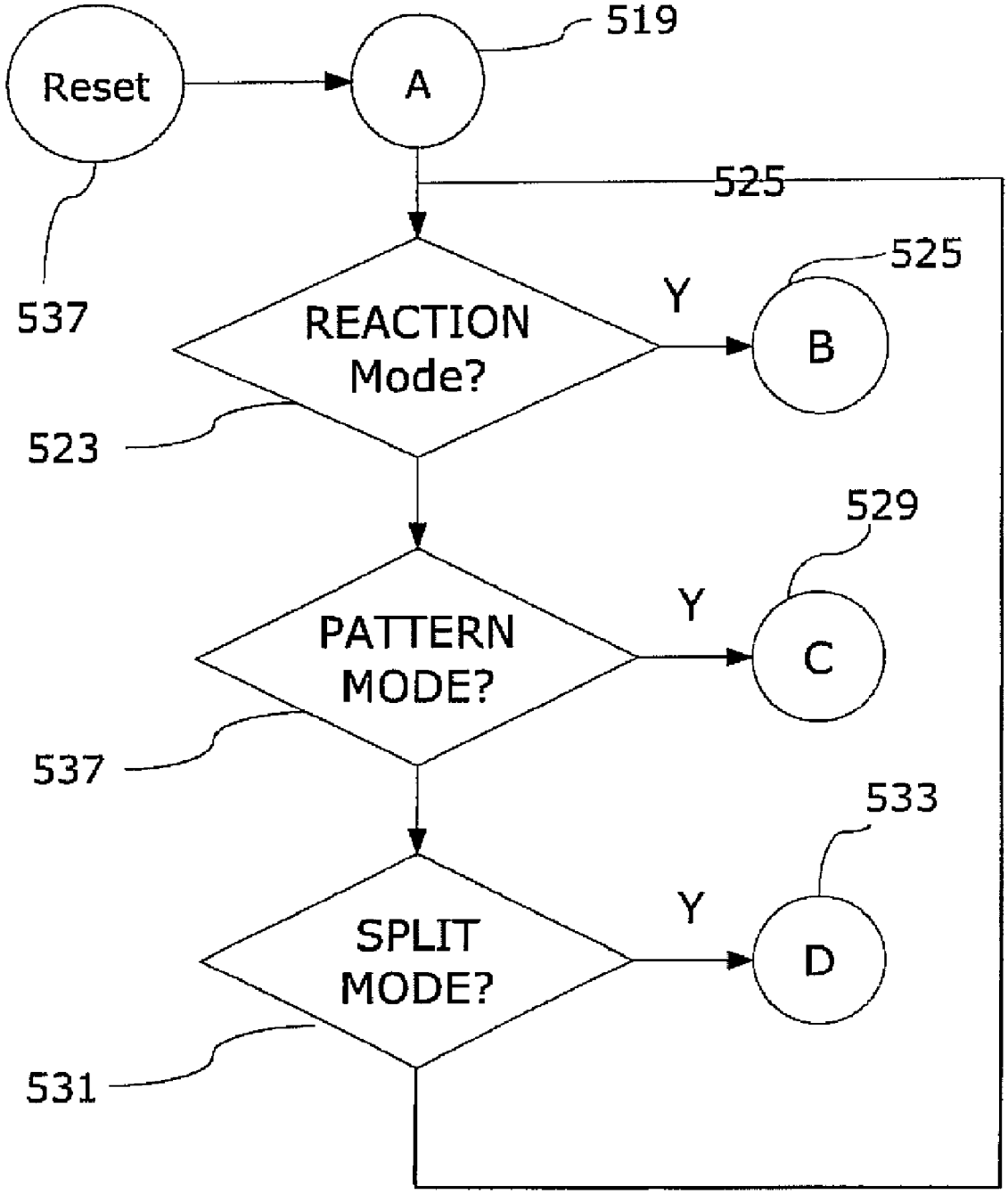

FIG. 9 shows the flow chart of the mode selection process.

Figure 10:
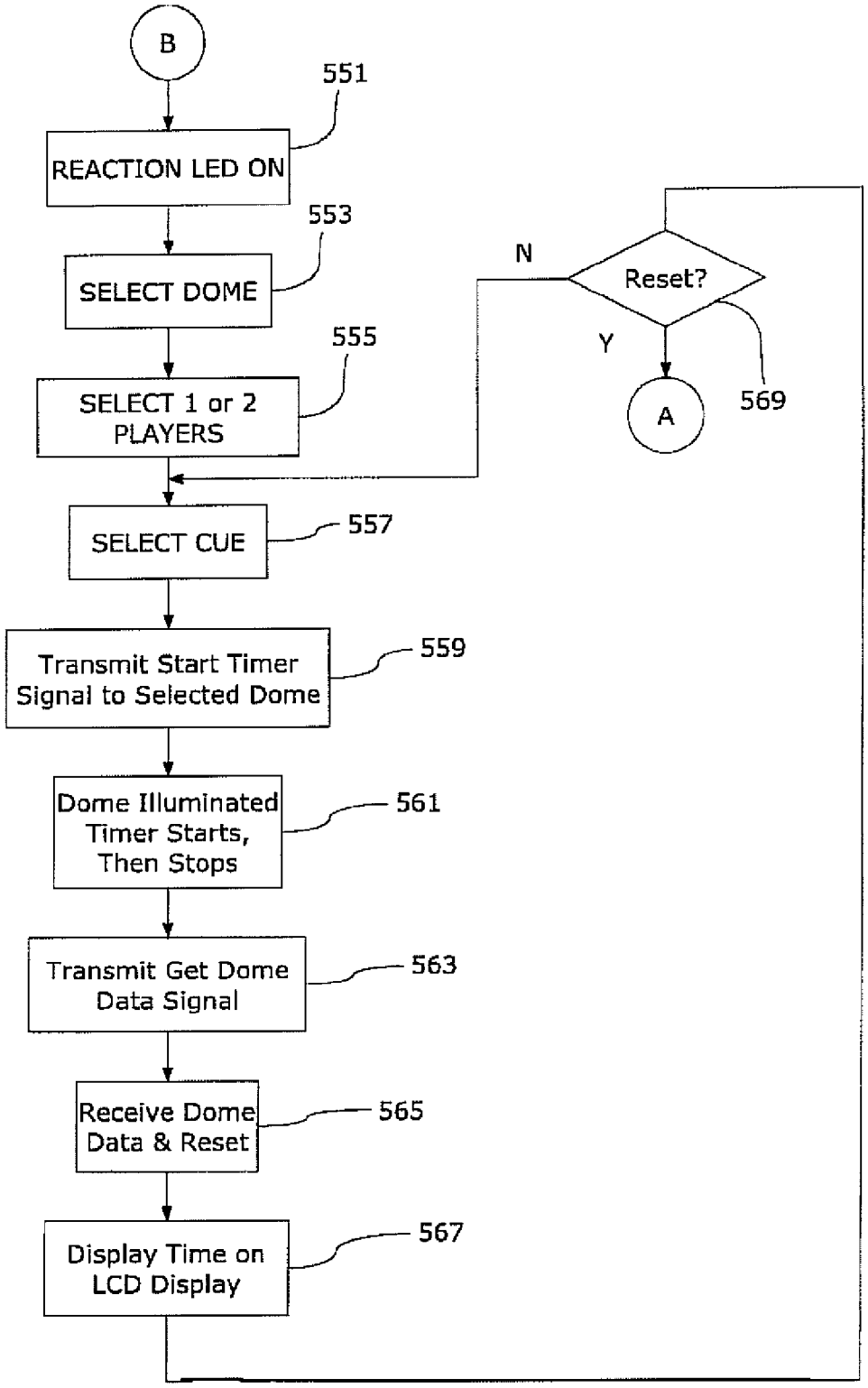

FIG. 10 shows the flow chart for the reaction mode of operation.

Figure 11:
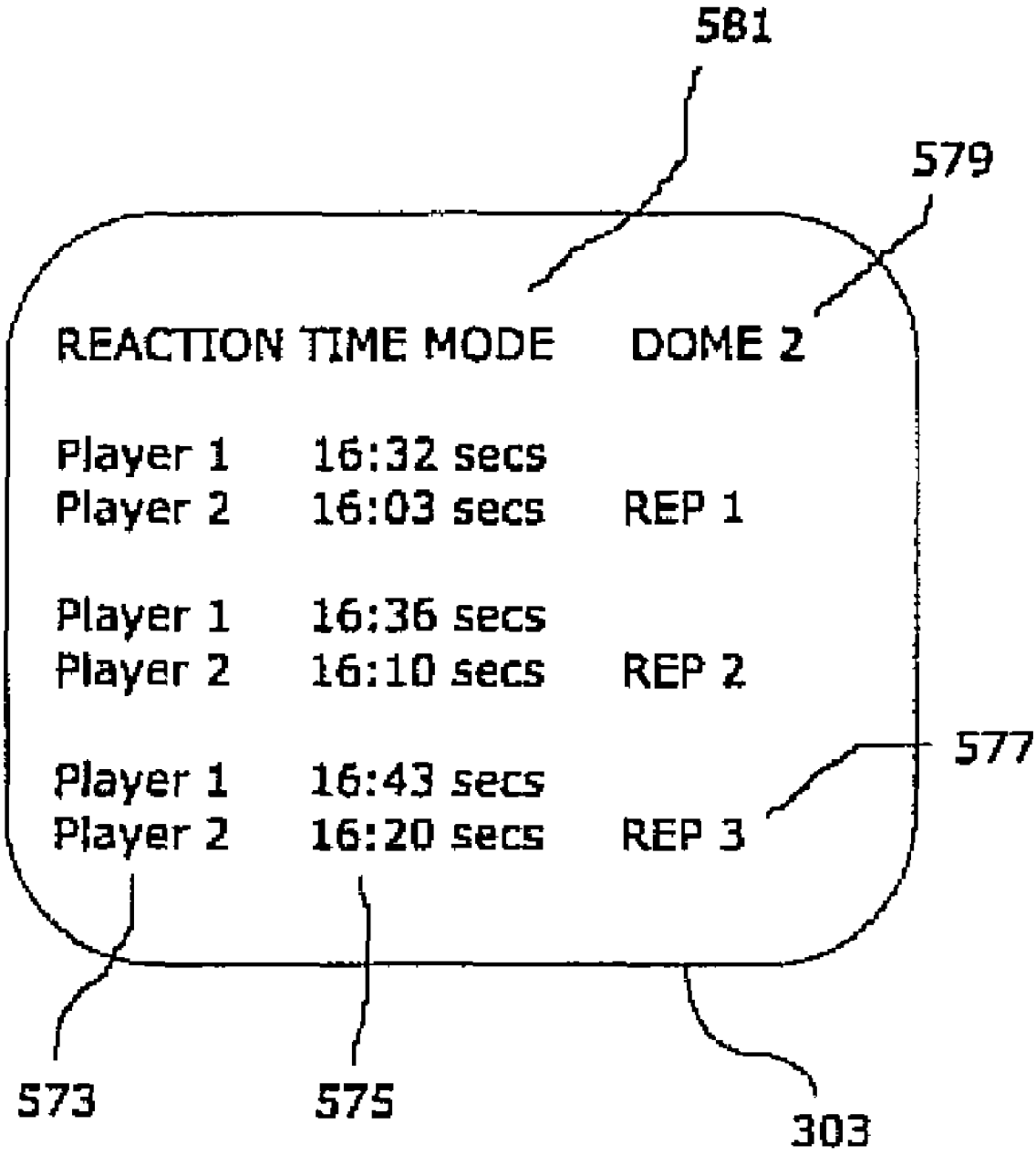

FIG. 11 illustrates the LCD display for the reaction mode.

Figure 12:
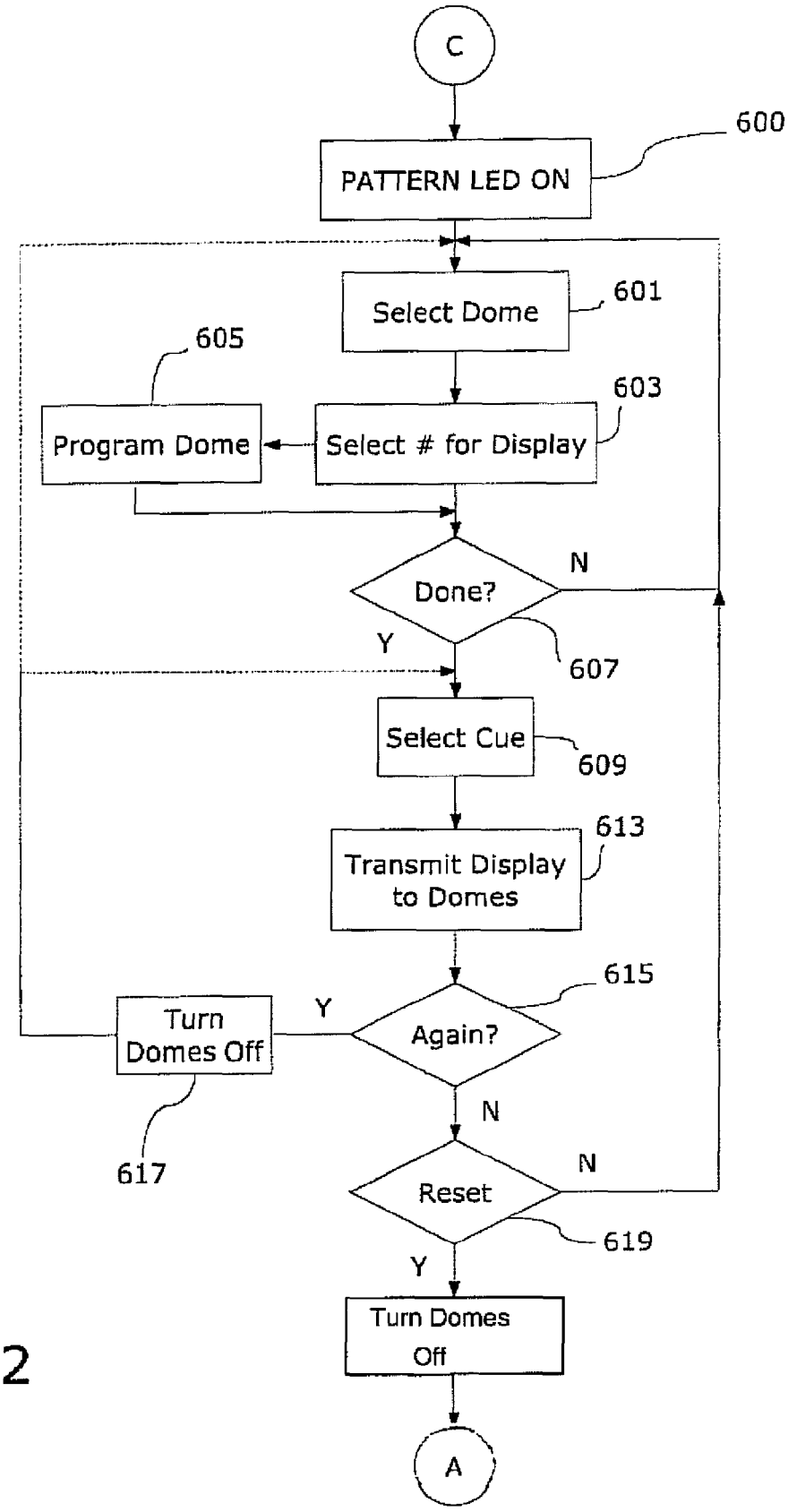

FIG. 12 shows the flow chart for the pattern mode of operation.

Figure 13:
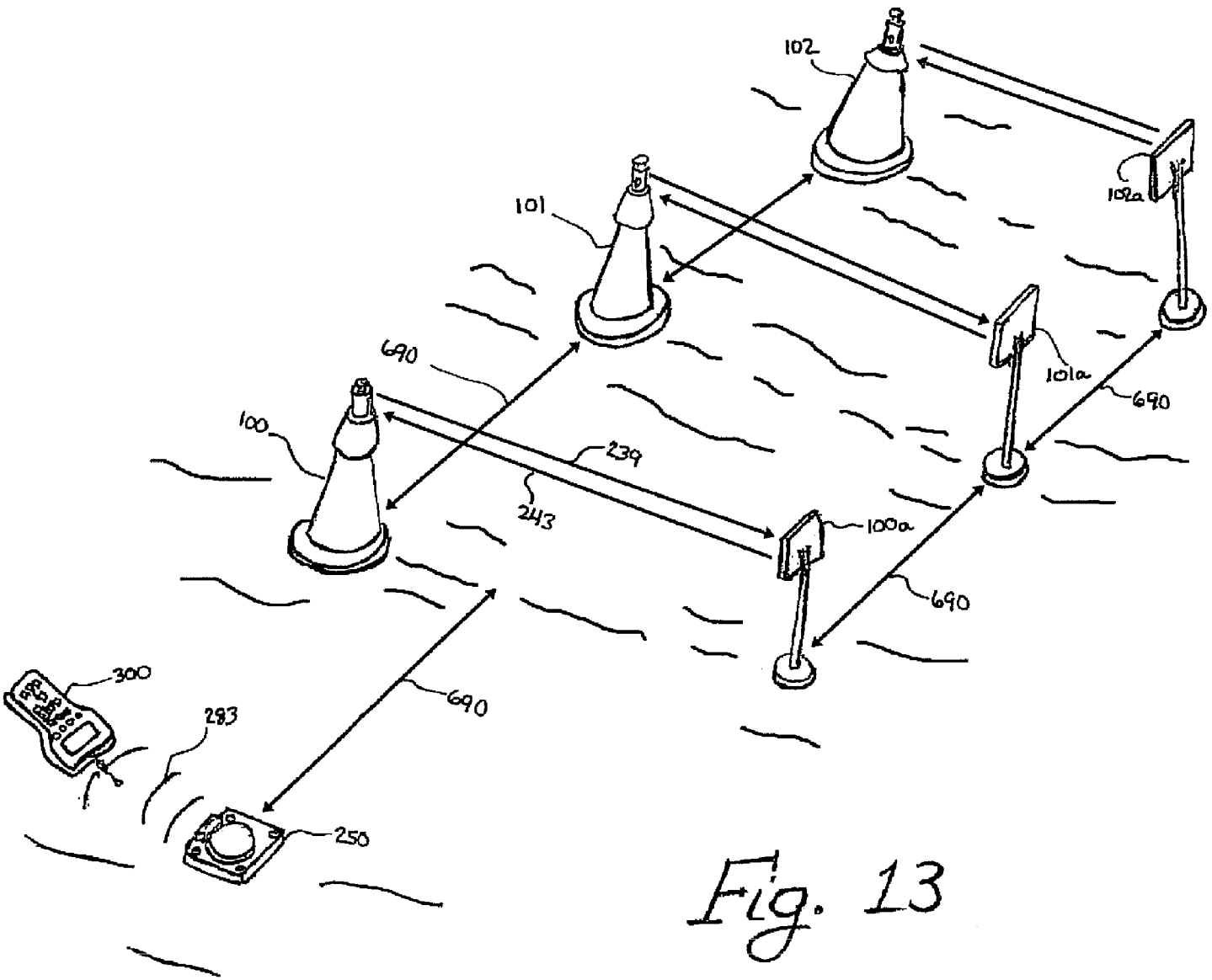

FIG. 13 illustrates the physical placement of the components for the splits mode of operation.

Figure 14:
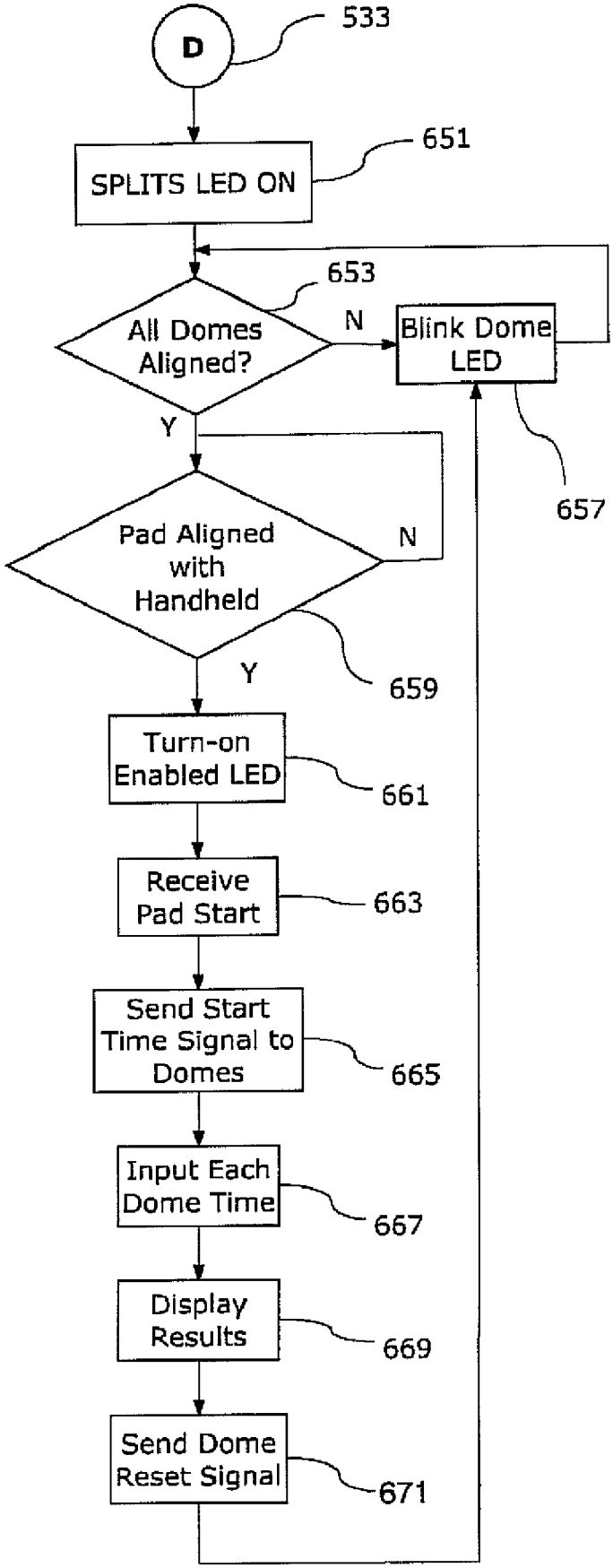

FIG. 14 shows the flow chart for the splits mode of operation.

Figure 15:
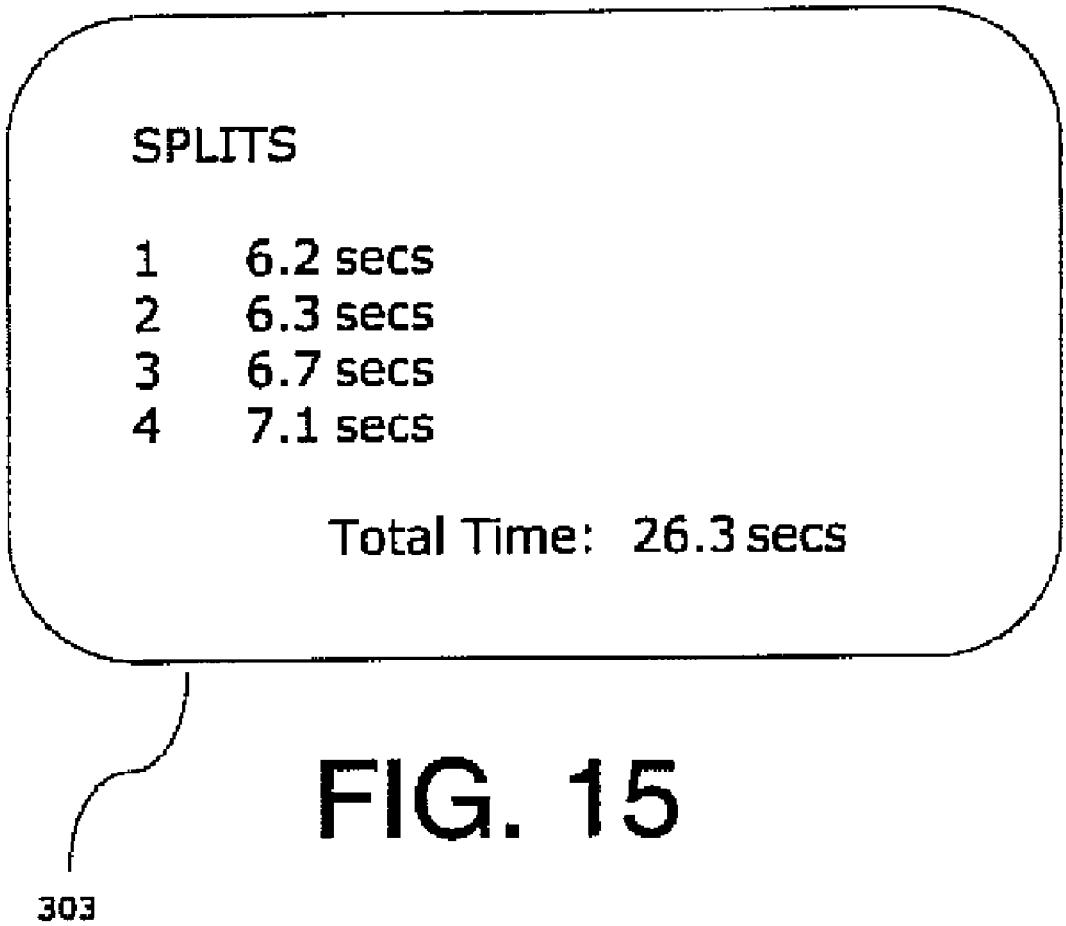

FIG. 15 illustrates the LCD display for the splits mode of operation.

Figure 16:
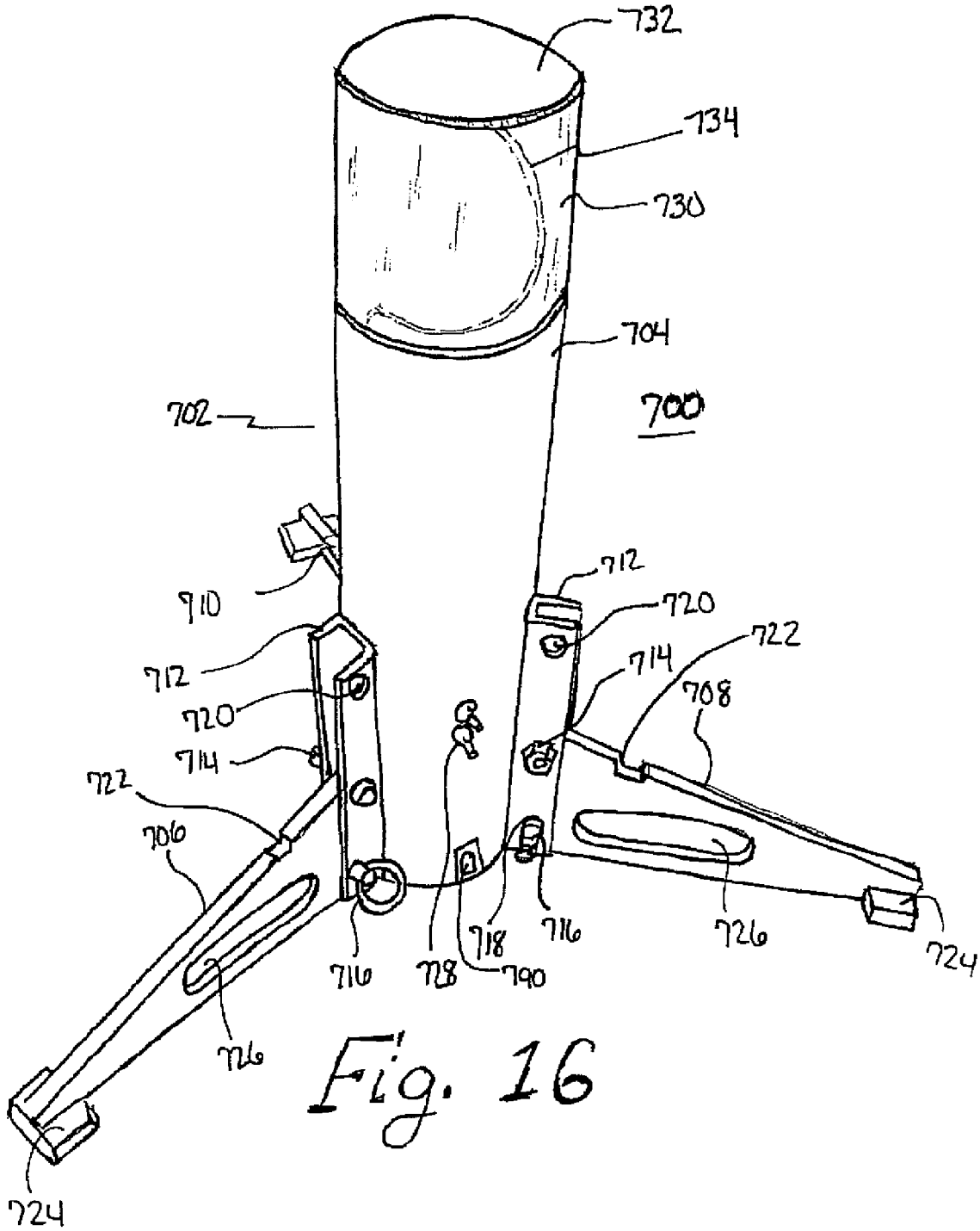

FIG. 16 is a perspective view from the top of an alternative embodiment of the touchpad unit of the present invention.

Figure 17:
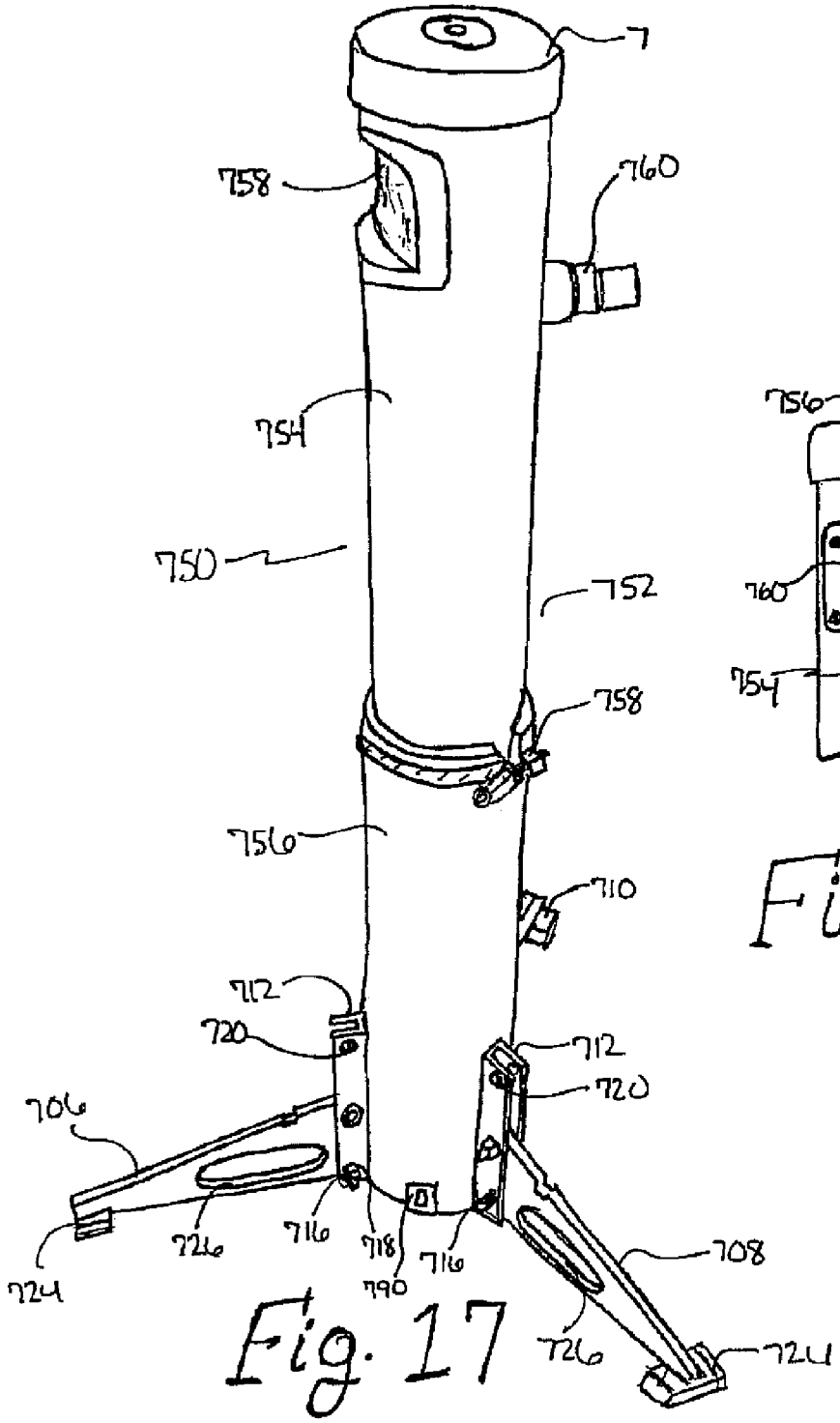

FIG. 17 is a perspective view of one side of an alternative embodiment of the training domes of the present invention.

Figure 18:
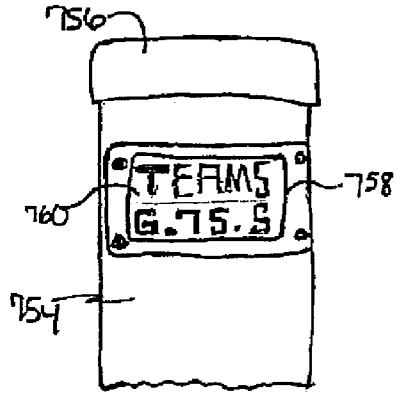

FIG. 18 is a close-up view of the display screen of the training dome shown in FIG. 17.

Figure 19:
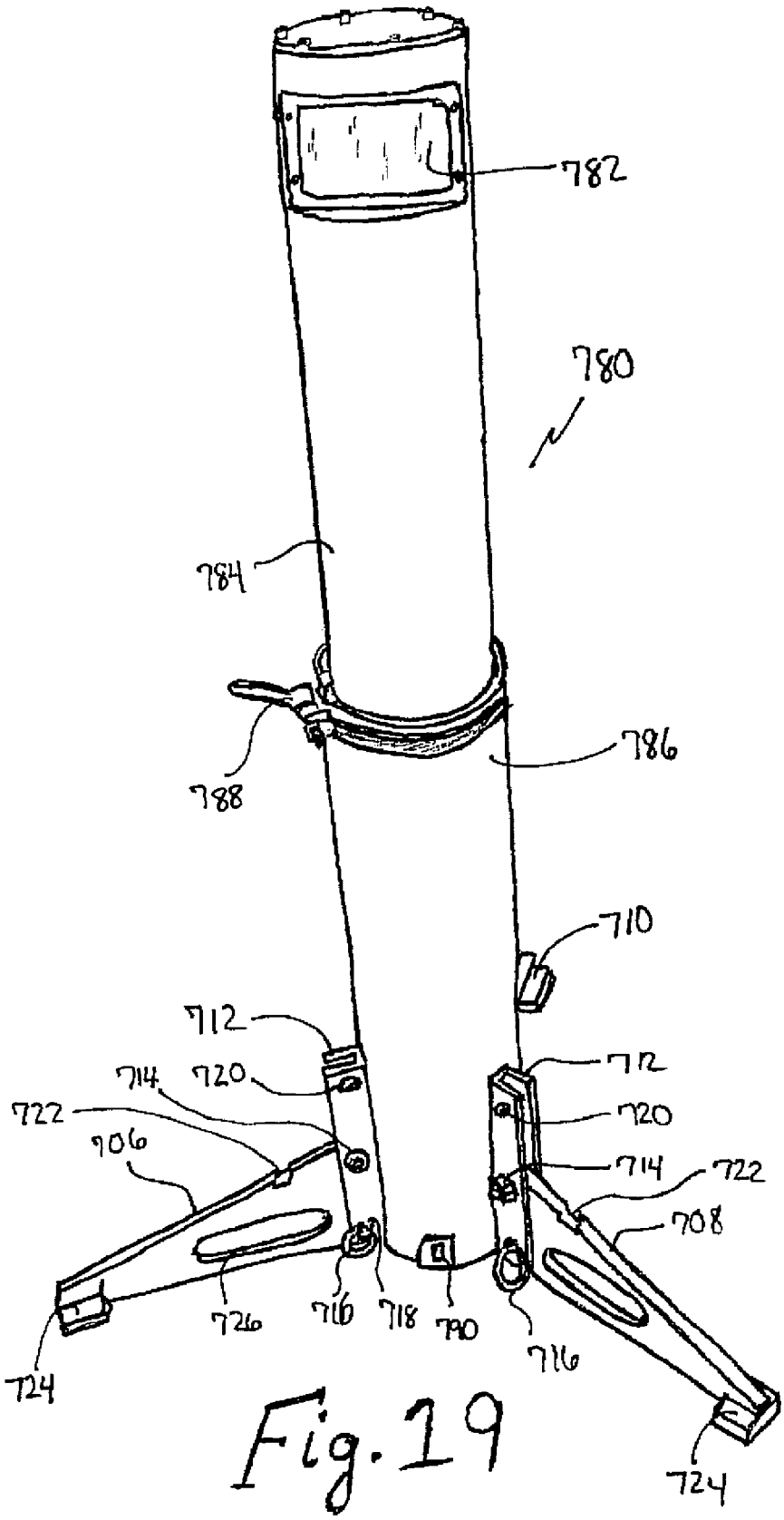

FIG. 19 is a perspective view of an alternative embodiment of the reflector units of the present invention.

DETAILED DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Fast moving sports, such as track, football, soccer and other similar sports require, for winning performance, quick reactions, maximum responses and changes from inactivity or relative inactivity to intense activity and maximum output. For example, a football receiver must sprint quickly ahead for a predetermined distance upon the snap of the ball, avoiding defensive players and then at an optimum distance, suddenly turn at almost a right angle and proceed at usually a lesser speed along a projection of said right angle to the prior movement, alertly watching for the throw of the ball and when the ball is thrown, alter his movement such that he will arrive at the spot where the thrown ball will return to the earth at the same time the ball descends. All such movements should be executed or completed, not only at a maximum speed, but at an output that will leave sufficient vitality to continue all expected further maneuvers. The player must also be aware through his senses of what is going on around him, adapting his movements to signals received, and when the ball is caught he must again frequently alter his course sharply toward the goal line, meanwhile watching and avoiding, if possible, all other players. Great players will be able to do this instinctively at least with a little practice, but other players may need to practice and train in order to attain the form of high intensity movements and patterns of movements executed at high speed and intensity characteristic of this sport. Usually the training necessary is provided by experienced coaches who either show the player "how to do it", or may have other players who know how show less experienced players how to do it while directing the entire operation. The same general pattern of training is inherently followed in most sports.

Special equipment has in the past been invented to aid coaches to provide the necessary instruction and training, but sometimes with limited results. The present invention, however, allows a considerably more varied repetition of training activities with a single apparatus system which not only aids coaches and trainers, but allows the players themselves to execute varied training moves and routines. Through the use of light and auditory signals received from the apparatus that can be placed at various locations and distances on a training field, a number of different training routines can be performed to increase a player's reaction time and execution of patterns of movement found within their sport.

FIGS. 1-15 illustrate a first mode of construction of the multi-functional athletic training device and system of the present invention, while FIGS. 16-19 illustrate an alternative construction of the components of the system. Wherever possible, like reference numerals to those in the previously described embodiment or other system components denote like elements or like functional means. The multi-functional athletic training device and system, which is generally indicated in FIGS. 1-15 by reference numeral 1, consists of one or more identical training domes 100, 101, and 102 (see FIG. 13), remote touchpad unit 250, and handheld unit 300. Additional training domes 103, 104, 105 etc. identical to domes 100-102 may also be provided as necessary, without deviating from the intended scope of the invention. Training domes 100-102, remote touchpad unit 250, and handheld unit 300 are each preferably battery operated and rechargeable. Additionally, the components of system 1 can be stored and transported in a conventionally constructed impact resistant aluminum case (not shown). As demonstrated below, domes 100-102 and touchpad 250 are preferably positioned on an exercise field 151 in a desired spaced-apart configuration, while handheld unit 300 is usually held and operated by a coach or other user/trainer. As shown in the example in FIG. 1, dome 100 is separated from dome 101 by a known distance 152, and domes 100 and 101 are positioned known distances 153 and 154 respectively from touchpad 250. Additional domes 102, 103 etc. can similarly placed on field 151.

Figure 2:
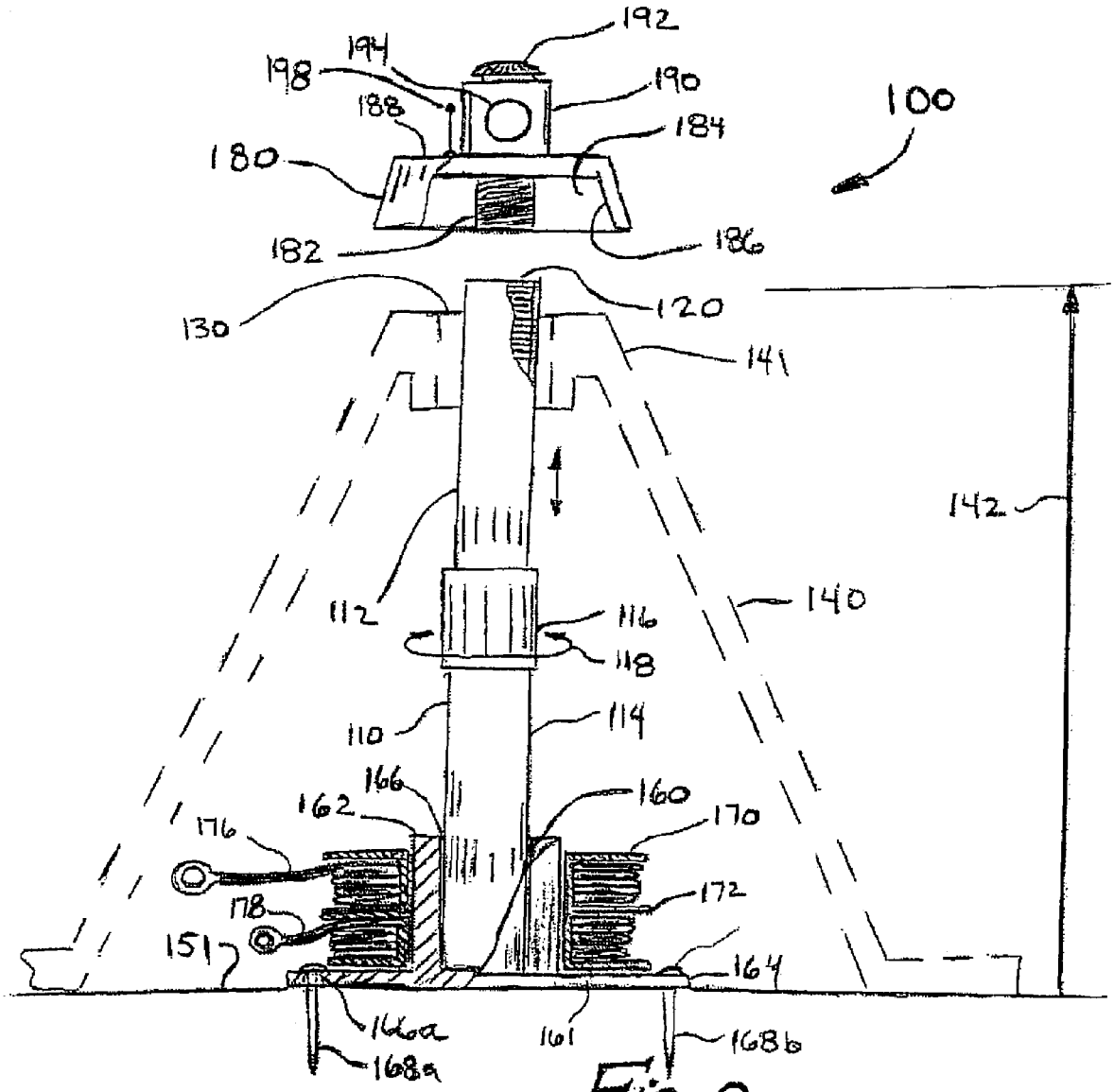
FIG. 2 illustrates a partially cut away view of a training dome of the system.

Referring in particular now to FIG. 2, there is shown in partial cross-section one of the training domes 100, which comprises a conventional telescopically extendable tubular support member 110, a lower support base 160, a communication module 180 and a covering 140, which as shown has the appearance of a conventional traffic cone but may have other appearances or shapes. Support member 110 is further comprised of upper member 112 and lower member 114, which members are preferably tubular in nature. A locking collar 116 attached to the distal end of lower member 114 is rotatable in a clockwise or counter clockwise direction as indicated by arrow 118, and allows upper member 112 to be telescopically extended from lower member 114 and then locked into place, thereby adjustably extending the length of member 110. Preferably, upper member 112 has a smaller diameter than lower member 114, and is extended out of lower member 114 a sufficient distance so that its upper end protrudes through top hole 130 of covering or traffic cone 140. Support member 110 can therefore be extended to accommodate coverings or cones 140 having different vertical lengths or height 142. The distal end of upper member 112 also has internal thread 120.

Support base 160 includes a bottom flanged ground support plate 164 which is placed on ground surface 151, and extending upwardly from ground support plate 164 is integral upright tubular support 162 in which the proximal end of lower support 114 of support member 110 is secured. The inside diameter 166 of tubular support 162 is slightly larger than the outside diameter of the proximal end of lower support 114, allowing support 114 to be easily inserted into base 160. A conventional clamping arrangement (not shown) of a type known to those skilled in the art is used to secure member 110 to base 160 (not shown). For example, this may be a friction fit of the proximal end of lower member 114 in tubular support 162. Four through-holes 166*a*, 166*b*, 166*c*, and 166*d* (166*b*-166*d* not shown) in ground support plate 164 are concentrically located around the periphery of plate 164, and have a diameter sized to accept stakes 168*a*, 168*b*, 168*c*, and 166*d* (166*c*-166*d* not shown), respectively. Stakes 168*a*-168*d* are to be driven into the ground surface 151 to further support base 160 and therefore vertical member 110.

Figure 1:
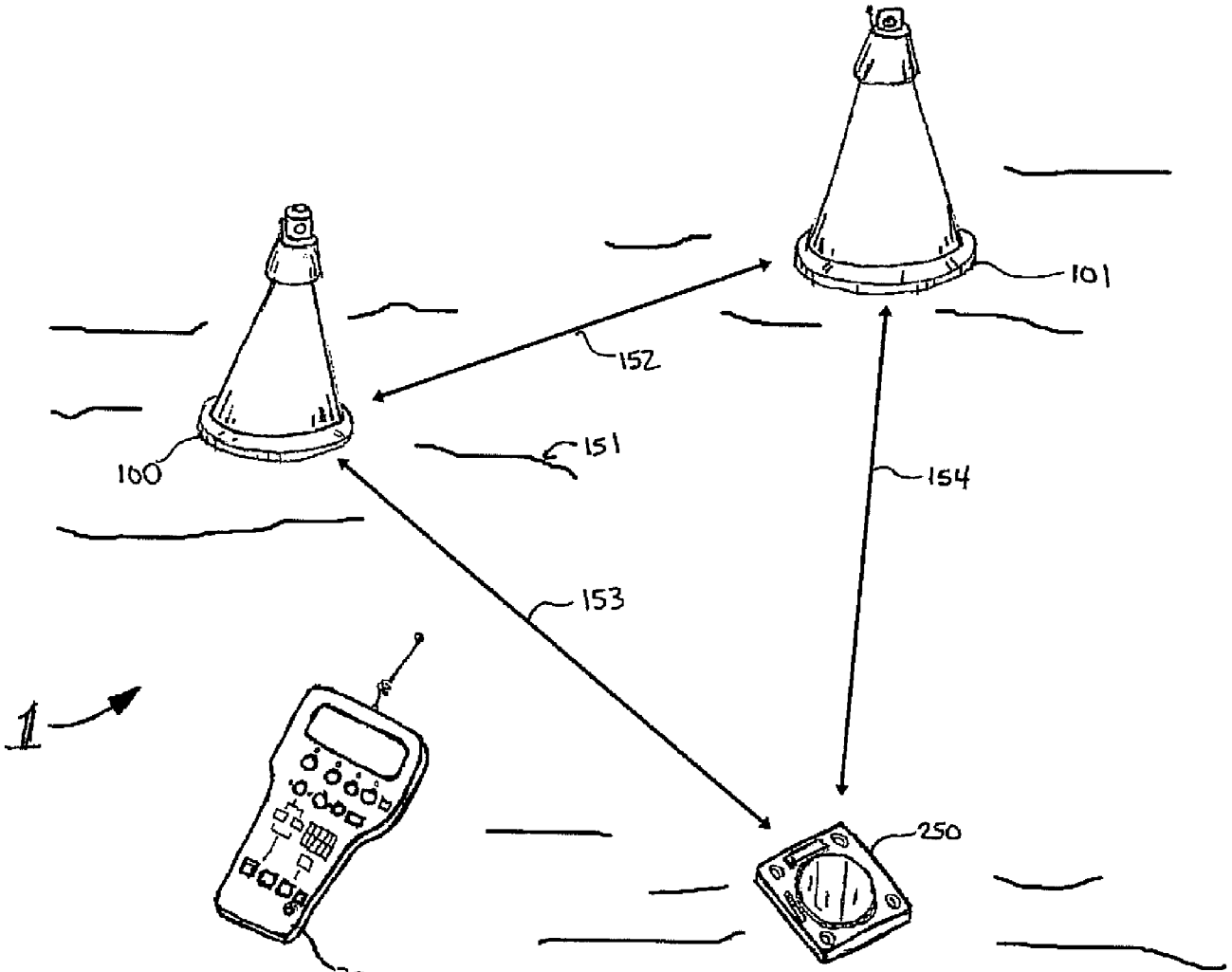
FIG. 1 is a perspective view of the system components of the multi-functional training system of the present invention arranged to accommodate reaction time exercise mode.

Referring still to FIG. 2, upright tubular support 162 also supports along its outer surface concentrically positioned upper cord chamber 170, which is stacked on top of lower cord chamber 172. Cord chambers 170 and 172 independently and axially rotate around the outside diameter of upright tubular support 162, and hold measuring cords 176 and 178, respectively. Cords 176 and 178 have visual delimiters such as every foot or thirty centimeters, and are retractably extended from base 160 during setup of the components of the system 1 for determining distances between training domes 100 and 101 and between cones 100 and 101 and touchpad 250, as illustrated in FIG. 1. Cord chambers 170 and 172 preferably include a latch mechanism (not shown) of a type that is similar to a conventional retractable tape measure.

Cylindrically shaped communication module 180 has an externally threaded lower support tube 182 extending downwardly from module 180. The external threads on support tube 182 match internal threads 120 of support 112, and lower support tube 182 is dimensioned to allow module 180 to be threadably secured to the distal end of telescoping upper support 112 of support member 110. Axially integral with tube 182 is downwardly directed chamber 184 having an outwardly sloped side surface 186 and a top surface 188. Mounted and axially aligned with top surface 188 is cylindrically shaped housing 190, on which a top accessible electrical push button switch 192 is mounted. Additionally, housing 190 includes a high intensity light emitting diode cover 194 on its side surface. Further enclosed within housing 190 is printed circuit board 196 (see FIG. 3) and battery 197 (not shown), while antenna 198 is electrically connected to circuit board 196, and is mounted to top surface 188 of chamber 184.

Figure 3:
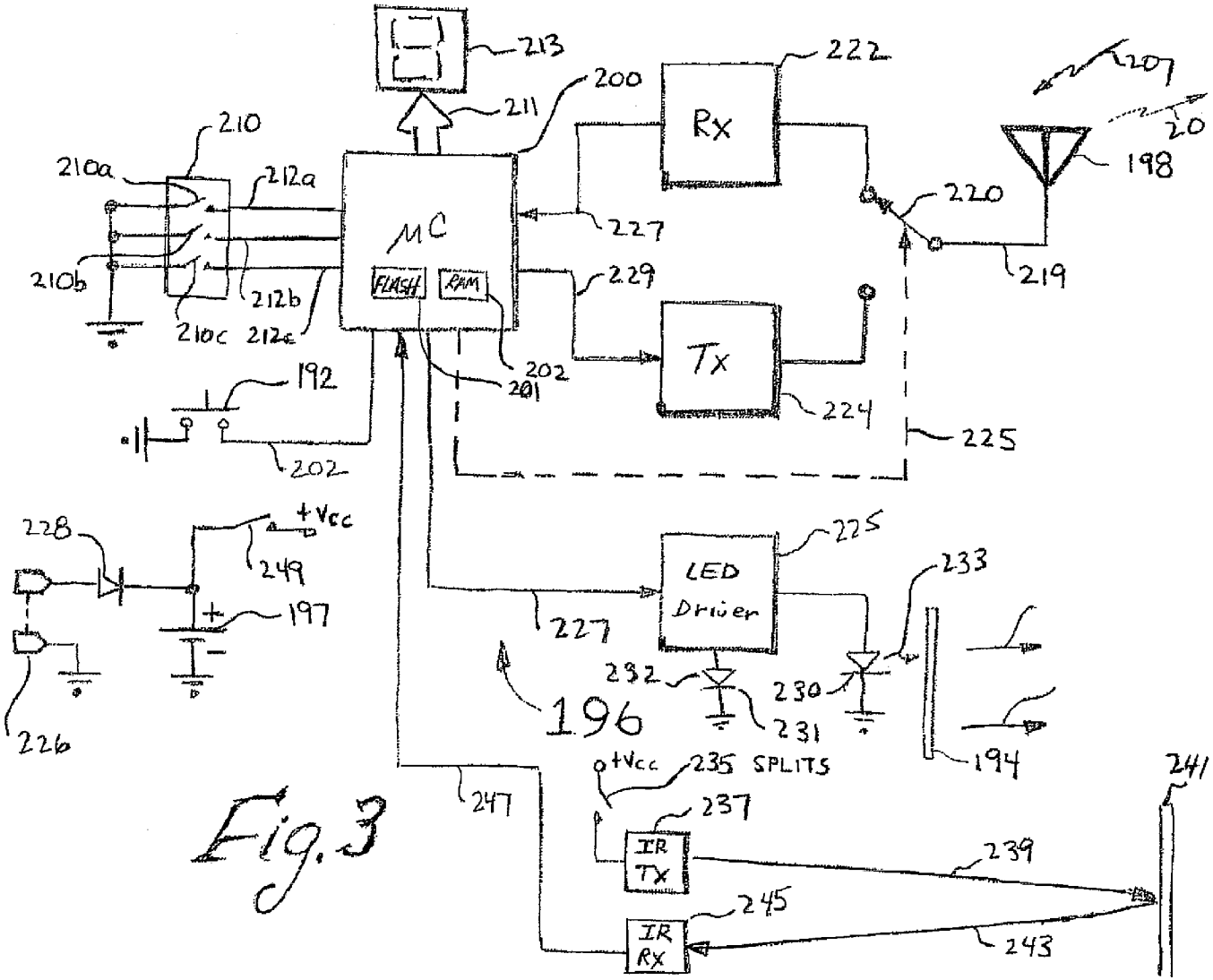
FIG. 3 illustrates the printed circuit board schematic of the training dome.

Referring now to FIG. 3, in which the printed circuit board schematic of training dome circuit board 196 is shown, circuit board 196 comprises a conventional microcontroller 200 having flash memory 201 for storing a program and random access memory 202 for storing program variables. Microcontroller 200 is preferably a low voltage, low power eight bit microcontroller such as a 68HC508 manufactured by Freescale Semiconductor. Connected to microcontroller 200 is switch matrix 210 having a plurality of individual switches 210*a*-210*c*. Also connected to microcontroller 200 is switch 192.

Microcontroller 200 has programmable pull-up resistors which are enabled for each switch input lines 212*a*-212*c* of matrix 210 and line 202 of switch 192. Thus, closing any of switches 210*a*-210*c* or closing switch 192 will pull down their respective lines to microcontroller 200. Further connected to microcontroller 200 via a seven line bus 211 is a display device, which is preferably a conventional seven segment high intensity light emitting diode display 213, but may also be another type of display such as a dot matrix display.

Antenna 198 connects to radio frequency switch 220 via line 219 and receives or transmits respective radio frequency signals 207 or 209. Switch 220 is controlled by microcontroller 200 via line 225 and either connects antenna 198 to radio frequency receiver 222 or connects antenna 198 to radio frequency transmitter 224, depending upon the signal placed onto line 225. Receiver 222 is connected to microcontroller 200 via line 227. Receiver 222 amplifies and demodulates signals 207 received by antenna 198.

Microcontroller 200 is further connected to transmitter 224 via line 229. Transmitter 224 is responsive to signals placed onto line 229 from microcontroller 200 and converts these signals to radio frequency signals, which are then placed onto line 219 via switch 220. The signals placed onto line 219 are then radiated by antenna 198 as signals 209. Thus, microcontroller 200 can receive signals 207 or transmit signals 209.

Microcontroller 200 further connects to light emitting diode driver 225 via line 227. Driver 225 is connected to high intensity white light emitting diodes 230 and 231 which, when activated by microcontroller 200 via line 227 and driver 225, produce respective visible light 233 and 232. Colored transparent filter 194 provides for the coloring of the LED white light into, for example, red, yellow and green light.

Additionally, circuit 196 further comprises an infrared transmitter module 237 having on/off switch 235. When powered on, module 237 transmits a focused beam of infrared radiation 239 onto a distant and externally mounted reflector 241. Reflector 241 reflects incident radiation 239 back towards infrared receiver 245 via infrared radiation 243. Receiver 245 in response to receiving reflection 243 places a signal onto line 247 which flows back to microcontroller 200. Transmitter 237 could also be a focused laser beam transmitter module.

Circuit 196 is powered by rechargeable battery 197. On/off switch 249 applies power to circuit 196. An external battery charger connects to and charges battery 197 via connector 226 and diode 228.

Referring now to FIG. 4*a*, there is shown in greater detail from the front or top remote touchpad unit 250 which consists of a rectangular shaped base 251 having a top mounted cap 253 secured in an aperture in the top surface of base 251. Corner through-holes 255*a*-255*d* extend through base 251 and allow the base to be securely held in place on the ground by inserting stakes through such through-holes 255*a*-255*d* and into ground surface 151 in a similar fashion for securing base 160 of training domes 100-102 to ground surface 151. In addition, infrared transmitting module 257 is mounted to the front or top of base 251, which when activated, transmits an infrared radiation signal 283. Also provided on the top surface of base 251 is on/off switch 261.

In FIG. 4*b*, which is a partially cut-away side view of touchpad unit 250, it is apparent that cap 253 is resting or positioned over or on top of stainless steel flexible dome 254, and furthermore dome 254 is resting on or secured to the upwardly facing surface of printed circuit board 271. Cap 253, dome 254 and printed circuit board 271 together form a metal dome electrical switch 273. Board 271 is conventionally mounted and secured to base 251 with screws (not shown). Cap 253 also has a flange 258 along its lower edge, which flange extends outwardly from the side surface of cap 253, and is positioned under lip 259 of base 251 surrounding the opening in which cap 253 is housed in base 251. Flange 258 thus prevents cap 253 from extending upwardly out of such opening beyond lip 259.

Referring now to FIG. 5, which shows the printed circuit board schematic of touchpad unit 250, electrical power is provided to pad 250 via on/off switch 261 and battery 263. Battery 263 is recharged via electrical connector 267 and diode 265. Audible sound beeper 274 is electrically connected in parallel with the series combination of infrared emitting diode 277 and current limiting resistor 275 to battery 263 via switch 261. The other end of the parallel combination connects to one terminal of switch 273. The opposite or other end of switch 273 connects to ground. Depressing cap 253 deforms dome 254 closing switch 273 allowing electrical current to flow through both beeper 274 which emits an audible tone and the series combination of diode 277 and resistor 275 which emits infra red radiation 283. Additional series combinations of resistor 279 and diode 281 may be added to increase infrared output power and/or increase the angle of transmission. Also, a radio frequency transmitter 285 having connected antenna 287 may also be added in parallel to beeper 274. Closing switch 273 activates transmitter 285 emitting radio frequency signal 289.

Referring now to FIG. 6, handheld control unit 300 comprises preferably a plastic case or housing 301. Case 301 has a top surface 302 and further encloses alphanumeric LCD display 303 and contains training dome pushbutton switches 305, 309, 313, and 317 and their respective visible dome light emitting diodes 307, 311, 315, and 319. SAVE DATA pushbutton switch 321 and ON/OFF switch 323 are additionally mounted on the top surface 302 of case 301, as are three mode pushbutton switches 325, 329 and 333 along with their respective visible mode light emitting diodes 327, 331 and 333. RESET pushbutton switch 337 is positioned on top surface 302 to the right of mode switch 333. Further switches on top surface 302 include Players 1 pushbutton switch 339 and Player 2 pushbutton switch 341, numeric pushbutton matrix 343 having numeric pushbuttons 0 through 9, and DONE 345, AGAIN 347, MANUAL VISUAL 349, MANUAL V & A (Visual and Audible) 351, CADENCE 355 and PAD 360 pushbutton switches. Dome selection switches 305, 309, 313 and 317 are grouped together, as are the mode selection switches 325, 329 and 335. On the back of case 301 (not shown) is an access compartment having address program switches 403, 405, 407 and 409 for programming unique addresses for each dome respectively corresponding to dome switches 305, 309, 313 and 317. The address set for each dome within case 301 corresponds to the address programmed for each dome via dome switch 210. ON/OFF switch 323 powers-on handheld control unit 300, and vertical antenna 427 is securely mounted onto case 301. Also mounted underneath case 301 is an audible beeper 441 (not shown). Also included within handheld unit 300 is a conventional bi-directional USB communication port, and housed within case 301 is a rechargeable battery 419, printed circuit board 401 and recharging jack 477, which items not shown in FIG. 6 but are referred to in the circuit diagram of FIG. 7.

Referring additionally to FIG. 7, printed circuit board 401 comprises circuit schematic 401*a* and includes microcontroller 402 having FLASH 450 and RAM 455 memory. FLASH 450 stores a program which is executed by microcontroller 402 and RAM memory 455 stores program variables. Microcontroller 402 is preferably a 16 bit 68HC5 12 microcontroller manufactured by Freescale Semiconductor. Switches 403, 405, 407 and 409 are connected to a port of microcontroller 402 via respective lines 404, 406, 408 and 410 and respectively correspond to the programming switches on each dome. For example, switch 403 corresponds to the address programming switch 210 for Dome 1, switch 405 corresponds to address programming switch 210 for Dome 2 etc. Also, individual switch 403*a* corresponds to switch 210*a* on Dome 1, individual switch 403*b* corresponds to switch 210*b* on Dome 1 etc.

Further connected to and in bi-directional communication via bus 461 with microcontroller 402 is liquid crystal display (LCD) 303. Conventional USB interface circuit 457 is connected to microcontroller 402 via bi-directional bus 459. LED matrix 411 corresponds to all of the LEDs contained within case 301 and is of conventional design and connects to microcontroller 402 via line 451. Likewise, switch 10 matrix 413 corresponds to all of the switches except for switch 417 contained within case 301 and is of conventional design and connects to microcontroller 402 via line 452. LED matrix 411 is arranged so that microcontroller can turn on one or more individual LEDs. Switch matrix 413 allows microcontroller to individually scan each switch and to determine if that switch has been depressed.

Further connected to microcontroller 402 via line 435 is infrared detector circuit 439. Detector circuit 439 receives infrared radiation 283 transmitted by diode 277 from touchpad 250. Also connected to microcontroller 402 via line 437 is audible beeper 441 which when activated produces audible tone 443. Additionally included within printed circuit board 400 is battery charger connector 477, charging diode 415, battery 419 and power switch 417.

The multi-functional athletic training device and system 1 of the present invention is a comprehensive training platform providing reaction time (REACTION), receiver pattern (PATTERN) and sprint/split (SPLIT) modes of operation. System 1 further provides for both the accurate and repeatable geometrical placement of system components thereby insuring consistent and accurate relative distances among system components even when the system has been removed from field 151 and placed at a different training location (for example, the system can be used inside as well as outside and will still maintain the exact geometric relationship among system components).

In use, all modes will first require that the system components be positioned on field 151 depending upon the selected mode. The system components will then need to be programmed to establish bi-directional radio frequency communication between domes 100, 101, 102 and 103 and handheld unit 300.

For REACTION mode, one dome is positioned a desired distance from the touchpad as shown in FIG. 1 using only dome 100 and touchpad 250. For PATTERN mode, one to four domes are each positioned a distance from the touchpad and from each other as shown in FIG. 1 using as an example domes 100 and 101 and touchpad 250. For SPLIT mode, one to four domes are aligned in a line and positioned a distance from the touchpad and from each other as shown in FIG. 13.

To position one or more of the domes onto field 151 (for example, dome 100 as shown in FIG. 1) the dome's respective base 164 is first placed a desired distance 153 from touchpad 250 using the delimiters on cord 176 to measure distance 153. To place a second dome (for example, dome 101 in FIG. 1) a desired distance 152 from dome 100 and a distance 154 from touchpad 250, respective cord 176 is used to measure distance 152 and cord 178 is used to measure distance 154. Thus, both cords can independently measure two distances from the respective dome to other system components. Having properly positioned the system components with respect to each other, the cords are unlatched and wound back onto their respective forms.

Locking ring 116 of support member 110 is then loosened so that upper member 112 can be extended past height 142 of cone 140. Ring 116 is then tightened rigidly securing upper member 112 to lower member 114 so that support member 110 is at the proper height. The proximal end of lower member 114 is then inserted into upright tubular support 162 166 of support base 160. Cone 140 is then positioned over member 110 so that the distal or upper end of upper member 112 protrudes a distance through the hole in the narrow end of cone 140. External threads 182 on cap 180 are then aligned with internal threads 120 on upper member 112 and cap 180 is threadably secured to member 112. As cap 180 is being screwed into or threadably connected to upper member 112 of support member 110, the beveled sides 186 of cap 180 forcibly contact and press against the upper outside portion 141 of cone 140, firmly anchoring member 110 to cone 140. The wide base of cone 140 adds stability for member 110. The height adjustability of member 110 allows the invention to be used with cones of various vertical heights 142 to accommodate both children and adults.

Having positioned the system components according to the desired operational mode, the system components are then programmed to establish bi-directional radio frequency communication between domes 100, 101, 102 and 103 and handheld unit 300. To program the system, the coach first programs the address of dome 100 by opening and/or closing one or more switches 210*a*, 210*b* and 210*c* of switch matrix 210. This address will be used by handheld unit 300 to uniquely communicate with dome 100. Likewise, if more than one dome is used such as dome 101, switch 210 matrix of dome 101 will be programmed in a similar fashion but with different 210*a*, 210*b* and 210*c* switch positions than those used for dome 100. Switch matrix 403 of handheld unit 300 is programmed with exactly the same switch state as dome 100. If dome 101 is also required, switch matrix 405 of handheld unit 300 is programmed with exactly the same switch state as dome 101, and if additional domes are being utilized, the same programming procedure would be repeated for such domes.

Referring to FIG. 8, which illustrates the initialization process for system 1, in step 501, the user applies power to dome 100 and handheld unit 300 by placing the respective power switches 249 and 417 into the ON position. Then, in step 503, a bi-directional communication link is established between handheld unit 300 and dome 100. After an internal power-on initialization process which defines the proper port configurations for microcontrollers 200 and 402, handheld unit 300 places switch 425 into the transmit position connecting antenna 427 to transmitter 417. Microcontroller 402 then sends an encoded radio frequency signal consisting of the address of dome 100 previously set using switch matrix 403 and a concatenated bounce-back command data word which instructs dome 100 to send back its address and the same concatenated command data word. Then, microcontroller 402 places switch 425 into the receive position, connecting antenna 427 to receiver 415. If the decoded address matches that previously programmed by switch matrix 210 for dome 100, microcontroller places switch 220 into the transmit position connecting antenna 198 to transmitter 224. The exact same address and command data word is then transmitted back to handheld unit 300. After transmission is completed, microcontroller 200 places switch 220 into the receive position.

After receiving the address and bounce-back command data word, microcontroller 402 compares the received address and command data word with that which was previously sent and if a match occurs, microcontroller 402 sends a signal via bus 451 to LED matrix 411 illuminating LED 307. Microcontroller then places switch 425 into the transmit position. Handheld unit 300 has now established a bi-directional communication link with dome 100.

This procedure for establishing a bi-directional communication link between handheld unit 300 and the remaining domes 101, 102, and 103 continues in steps 507 through 517. Thus after the steps outlined in FIG. 8 have been completed, handheld unit 300 knows which domes are on-line and communicating properly with unit 300 and informs the user by activating the respective LEDs 307, 311, 315 and 319. Simultaneously depressing all of the dome switches 305, 309, 313 and 317 in step 521 forces a complete reset system command and the entire process of FIG. 8 is repeated.

Referring now to FIG. 9, microcontroller 402 then scans the mode switches 325, 329 and 335. If a mode switch is depressed, microcontroller identifies which mode switch was depressed and proceeds to the respective process. In step 523, if REACTION mode switch 325 is depressed, microcontroller proceeds to step B 525. In step 527, if PATTERN mode switch 329 is depressed, microcontroller proceeds to step C 529. In step 531, if SPLIT mode switch is depressed, microcontroller proceeds to step D 533. If no modes switches are depressed, microcontroller 402 continues to scan these switches. Depressing RESET switch 337, as indicated by step 537, causes microcontroller 402 to again begin scanning the mode switches 325, 329, and 335.

REACTION Mode:

Referring now to FIG. 10, in step 551 microcontroller 402 turns on corresponding LED 327 giving a visual indication to the user that the REACTION mode has been accepted by the microcontroller. The user then selects the chosen dome in step 553 by depressing one of the dome switches 305, 309, 313 or 317. In response to this selection, microcontroller 402 responds by turning on the corresponding switch LED 307, 311, 315 or 319 to indicate visually on handheld unit 300 which dome 305, 309, 313, or 317 was selected. The user then selects either one player by depressing switch 339 or two players by depressing switch 341 in step 555. The user then selects the type of cue method in step 557, by which the user will be prompted to perform the training program. Four types of cue methods are provided and include MANUAL VISUAL, MANUAL V&A, CADENCE and PAD having the respective switches 349, 351, 355 and 360.

The MANUAL VISUAL cue is initiated when the user depresses switch 349. Microcontroller 402 inputs the state of the switches address switches 403, 405, 407 or 409 depending upon the dome selected in step 553. Then, microcontroller 402 transmits the dome address and a "start timer" and "light LED" command to the selected dome in step 559. In response to the transmitted signal, the selected dome turns on LED driver 225 which in turn illuminates LED 230 on the selected dome and starts an internal timer in step 561, thus providing a visual signal to the player. The player then races to the illuminated dome and depresses switch 192 which stops the internal timer. The time increment between start timer transmission (step 559) and depressing switch 192 (step 561) is stored in microcontroller 200 and is defined as the reaction time.

In step 563, microcontroller 402 communicates with the selected dome to transmit back to the microcontroller the stored reaction time. In step 565, microcontroller receives the reaction time from the dome, and in step 567 displays the data onto LCD screen 303. More particularly, as shown in FIG. 11, LCD screen 303 may be programmed to display the type of event 581, the selected dome 579, the player or players (in this display, two players have been selected in step 555), the reaction time 575 in seconds, and the repetition number 577. As shown in FIG. 11, a plurality of reaction time tests may be provided for each player, with the results of such tests being displayed simultaneously on LCD screen 303. In step 569, microcontroller 402 scans the RESET switch 337 and if depressed exits to A step 519. Otherwise another reaction time event begins with the depressing of a cue switch.

If MANUAL V & A (Manual Visual & Audible) is selected in step 557 by depressing switch 351, the steps in the routine are similar to the MANUAL cue except that handheld unit 300 produces an audible signal with microcontroller 402 enabling beeper 441 in addition to activating LED 230 on the addressed dome.

Selecting the CADENCE cue in step 557 by depressing switch 355 causes handheld unit 300 to produce two short audible tones followed by a longer tone which mimics a quarterback's "hut-hut-hut" cadence. At the beginning of the long tone handheld unit 300 transmits the appropriate start timer signal to the selected dome in step 559.

Before selecting the PAD cue, which refers generally to the use of touchpad 250, the player first positions himself over touchpad 250 and depresses cap 253 of electrical dome switch 273 which activates infrared diode 277, producing an infrared transmission 283 and also producing an audible tone from beeper 274. The coach then points handheld unit 300 towards touchpad 250 and aligns infrared receiver 439 with touchpad 250 receiving infrared transmission 283. If microcontroller 402 is receiving signal 283, LED 365 is activated via bus 451 and LED matrix 411. A short tone is then produced by microcontroller 402 via beeper 441 which audibly informs the player to begin the event. As soon as the player releases switch 273, infrared signal 283 terminates which is subsequently detected by handheld unit 300 which then transmits the appropriate start timer signal to the selected dome in step 559. The reaction time of the player is then calculated as previously described.

PATTERN Mode:

Referring to FIG. 12, the PATTERN mode is selected by depressing switch 329. Microcontroller 402 in response to this selection turns on LED 331 in step 600. The user then selects a dome by depressing one of the dome switches 305, 309, 313, or 317 in step 601. The user then selects a number to be subsequently displayed by the selected dome from switch matrix 343 in step 603. After selecting a number from switch matrix 343, microcontroller 402 transmits the respective dome address and the selected number data to the addressed dome. In step 605, the addressed dome responds by storing the selected number data into its corresponding RAM 202. In step 607, microcontroller 402 scans DONE switch 345 and either returns to step 601 to program another dome or continues to step 609. In step 609, the user selects one of the four cue switches MANUAL VISUAL 349, MANUAL V&A 351, CADENCE 355 and PAD 360 previously described in the Reaction Mode section.

Having selected the cue in step 609, in step 613 microcontroller 402 sequentially transmits each selected dome address along with a DISPLAY NUMBER command. In response to the handheld unit 300 transmission, each addressed dome responds by displaying the previously transmitted and subsequently stored number onto seven segment LED display 213.

The user can again repeat the drill by depressing AGAIN switch 347 in step 615. If the AGAIN switch is depressed, program flow continues to step 617 in which microcontroller 402 sends a corresponding address and reset signal to each dome. In response to the reset signal, each dome shuts off their respective seven segment display 213. Program flow then returns to step 609 (if a cue is selected by depressing one of the cue switches 349, 351, 355 or 360) or back to step 601 to reprogram a selected dome with a new display number. If RESET switch 337 is depressed in step 619, program flow continues step 621 where microcontroller 402 sends a reset signal to each dome shutting off their respective seven segment display 213. Program flow then continues to A step 519 where microcontroller 402 again scans the mode switches.

SPLIT Mode:

In the SPLIT mode of operation, as shown FIG. 13, the domes (for example three domes 100-102 in FIG. 13) are aligned in a straight line and are separated a distance 690 from each other and from touchpad 250. Such distances are measured using the measuring cords 176 and 178 stored in base 160 of the domes as previously described. In addition, corresponding infrared reflectors 100*a*, 101*a* and 102*a* are positioned opposite and equidistant from their respective domes 100, 101 and 102. Reflectors 100*a*, 101*a*, and 102*a* are represented in FIG. 3 by reflector 241. A running lane is therefore established, with as illustrated in FIG. 13 the aligned domes forming the left boundary line and the aligned reflectors forming the right boundary line, with touchpad 250 positioned in the center of the lane. The user then closes switch 235 on each dome turning on infrared transmitter 237 (or laser beam transmitter as previously described) which transmits signal 239 to reflector 241. Each respective reflector must be aligned to reflect infrared signal 239 as signal 243 back to infrared detector 245. When reflected infrared signal 243 is received by receiver 245, aligned LED 233*a* on the dome is turned on giving a visual indication 232 to the user that transmitter 237, reflector 241 and receiver 245 are properly aligned.

Referring to FIG. 14, the SPLITS mode is selected by depressing switch 335 in step 531. Microcontroller 402 in response to this selection turns on LED 333 in step 651. Program flow then continues to step 653 where microcontroller 402 polls each dome for proper alignment with their respective reflectors by sequentially addressing each dome and sending an ALIGNMENT command. The addressed domes send back either a good alignment of bad alignment response. If any dome is not aligned with its respective reflector, microcontroller 402 directs the corresponding dome LED 307, 311, 315 and/or 319 in step 657 to flash or blink.

Program flow then continues to step 659 where the player positions him or herself over touchpad 250 and depresses cap 253 of dome electrical switch 273, which activates infrared diode 277 and produces an infrared transmission 283. The coach then points handheld unit 300 towards the touchpad 250 and aligns infrared receiver 439 with touchpad 250 receiving infrared transmission 283. In step 661, if microcontroller 402 is receiving signal 283, LED 365 on handheld unit 300 is activated via bus 451 and LED matrix 411. A short tone is then produced by microcontroller 402 via beeper 441 which audibly informs the player to begin the event. In step 663, as soon as the player releases switch 273, infrared signal terminates which is subsequently detected by handheld unit 300. In step 665 and in response to the player releasing switch 273, microcontroller 402 transmits a timer start signal to each aligned dome 100, 101, 102 etc. which starts each dome's timer.

As the player runs past each dome-reflector pair 100-100*a*, 101-101*a*, 102-102*a*, etc., the corresponding incident 239 and reflected 243 infrared beam is interrupted, which is detected by each dome's respective microcontroller 200 stopping its timer. In step 667, handheld unit 300 polls each dome and inputs their respective accumulated timer values.

Referring now to FIG. 15, and in step 669, microcontroller 402 displays all of the timer results on LCD screen 303 displaying the times for each distance traveled by the player. For example, Split 1 represents the elapsed time from the moment the player released switch 273 until the player reached dome-reflector pair 100-100*a*, Split 2 represents the computed elapsed time from the player reached dome reflector pair 100-100*a* until the player reached dome-reflector pair 101-101*a*, determined by subtracting the elapsed time from releasing switch 273 and reaching dome-reflector pair 100-100*a* from the elapsed time from releasing switch 273 and reaching dome-reflector pair 101-101*a*. The split times between reaching dome-reflector pairs 102-102*a* and 103-103*a*, as well as the total elapsed time, are also displayed.

The athletic training apparatus and system of the present invention is thus extremely versatile and capable of coordinating performance of a variety of different training routines according to the needs and requirements of athletes. FIGS. 16-19 illustrate an alternative construction of the components of the multi-functional training system 700 of the present invention. In FIG. 16, there is shown touchpad unit 702 which in the present embodiment consists of a cylindrically shaped vertically extending housing 704 having tripod-type legs or supports 706, 708, and 710 connected to the lower end of housing 704 by U-shaped channel members 712. More particularly, legs 706, 708, 710 are pivotally connected between the arms of channel members 712 by pivot bolts 714, and are pivotable between a support position as shown in FIG. 16 wherein the legs are extended outwardly, and a storage position, not shown, wherein legs 706, 708, 710 are pivoted upwardly so that they are aligned substantially parallel to the longitudinal axis of cylindrical housing 704. Legs 706, 708, 710 are secured in a support position by pins 716 which are passed through apertures 718 in the lower end of channels 712 and through corresponding apertures in each of the leg members. Similarly, legs 706, 708, 710 are secured in a storage position by removing pins 716 from apertures 718, pivoting the legs upwardly, and then passing pins 716 through apertures 720 in the upper end of channels 712, and matching notches 722 or other aligned apertures on legs 706, 708, 710. Ground engaging foot members 724 are provided on the outer ends of legs 706, 708, 710, and the legs each include a handhold area 726 to facilitate gripping, carrying and pivoting the legs during setup and storage of unit 702. Meanwhile, transparent or translucent cylindrical housing section 730 is secured on the upper end of housing 704, and cap 732 is mounted on top of housing 724. Touchpad unit 702 also contains an infrared transmitting module similar to the previously described embodiment, which is preferably mounted to housing section 730, and which when activated transmits an infrared signal.

Also provided on housing 704 is and on/off switch 728. Cap 732 is electrically connected to wire 734 and serves as an electrical switch or button that activates the infrared signal which signal is then transmitted in the manner already described or in another manner that will be evident to those skilled in the art to the handheld unit, shown in FIG. 20. Touchpad unit 702 and cap 732 are provided to indicate in at least one mode of operation that the athlete is ready to begin an exercise course or training session. Thus, in the embodiment shown in FIG. 16, the cap or activation switch is raised off of the ground a distance so that it is within easy reach of the athlete's hand in a standing or ready position, rather than as in the embodiment shown in FIGS. 4*a* and 4*b* being in close proximity with the ground surface so the athlete must either contact the cap or switch with their foot or bend over and contact the switch with one of their hands. Touchpad unit 702 also preferably includes a battery power unit, and may comprise a printed circuit board schematic as shown in FIG. 5, a sound beeper is also preferably provided that will emit an audible beeping sound when the athlete is ready to begin.

FIG. 17 illustrates one the training domes 750 having an alternative construction, which construction at least with respect to the base portion is generally similar to touchpad unit 702. Additional training domes identical to dome 750 may also be provided as necessary, without deviating from the intended scope of the invention. As in the previous embodiment, training dome 750 includes a vertically disposed housing or support member 752 that is further comprised of inner member 754 and outer member 756, which members are preferably tubular in nature with inner member 754 being telescopically and slidably adjustable in outer member 756. A clamping member such as hose clamp 758 is attached to the upper end of outer member 756 which when tightened secures inner member 754 at a desired height or position, thereby adjustably extending the length of member 752 for use in different training scenarios as desired, or when training dome 750 is not in use inner member 754 may be moved downwardly so that it is substantially contained or stored in outer member 756.

In addition, similar to touchpad unit 702, housing or support member 752 is held in a vertical position by tripod-type legs or supports 706, 708, and 710, which are connected to the lower end of housing 752 by U-shaped channel members 712. Legs 706, 708, 710 are pivotally connected to channel members 712 by pivot bolts 714, and are pivotable between a support position as shown in FIG. 17 and a storage position, not shown, wherein legs 706, 708, 710 are pivoted upwardly so that the legs are aligned substantially parallel to the longitudinal axis of cylindrical housing 752. Legs 706, 708, 710 are secured in a support position by pins 716 which are passed through apertures 718 in the lower end of channels 712 and through corresponding apertures in each of the leg members. Similarly, legs 706, 708, 710 are secured in a storage position by removing pins 716 from apertures 718, pivoting the legs upwardly, and then passing pins 716 through apertures 720 in the upper end of channels 712, and matching notches 722 or other aligned apertures on legs 706, 708, 710. Ground engaging foot members 724 are also provided on the outer ends of legs 706, 708, 710, and the legs each include handhold areas 726 to facilitate gripping, carrying and pivoting the legs during setup and storage of unit 750.

Referring still to FIG. 17, mounted on the upper end of inner telescoping member 754 is cap or electrical push button switch 759. Additionally, a high intensity light emitting diode cover 758 is provided in the side surface of inner member 754, preferably near its upper end, and as best shown in FIG. 18 underneath cover 758 there is a display device 760 such as seven segment LED display 213 LED display which is electrically connected to a battery power supply and in communication with the system as illustrated in FIG. 3 or in another similar arrangement of a type that will be evident to those skilled in the art. Similar to the schematic illustrated in FIG. 3, an antenna and radio frequency transmitter are also provided, and the circuit further comprises an infrared transmitter/receiver 760 which when powered on transmits a focused beam of infrared radiation outwardly.

Infrared transmitter/receiver 760 may be aligned with the reflector 782 of reflector a unit 780, as shown in FIG. 19, which when properly aligned similar to the arrangement shown in FIG. 13 with respect to the previously described embodiment which reflects incident radiation back to infrared receiver 260. Receiver 260 in response to receiving such reflected infrared signal in turn sends a signal to be device microcontroller, and a signal light confirming such alignment is activated. Transmitter 760 could a so be a focused laser beam transmitter module.

As shown in FIG. 19, reflector housing 780 is similar in construction to training dome 750, and includes a vertically disposed housing or support member that is further comprised of inner member 784 and outer member 786, which members are preferably tubular in nature with inner member 754 being telescopically adjustable in outer member 756. A clamping member such as hose clamp 788 is attached to the upper end of outer member 786 which when tightened secures inner member 784 at a desired height, thereby adjustably extending the length of reflector housing 780. Preferably, inner and outer members 784 and 786 have similar lengths to members 754 and 756 of training domes 750 so that it will be easy to align infrared transmitter/receiver 760 at the same height as reflector 782. Reflector housing 780 is held in a vertical position by tripod-type legs or supports 706, 708, and 710, which are connected to the lower end of outer member 786 by U-shaped channel members 712. Legs 706, 708, 710 are pivotally connected to channel members 712 by pivot bolts 714, and are pivotable between a support position as shown in FIG. 19 and a storage position with legs 706, 708, 710 pivoted upwardly and aligned substantially parallel to the longitudinal axis of cylindrical housing 704. Legs 706, 708, 710 are secured in a support position by pins 716 which are passed through apertures 718 in the lower end of channels 712 and through corresponding apertures in each of the leg members. Similarly, legs 706, 708, 710 are secured in a storage position by removing pins 716 from apertures 718, pivoting the legs upwardly, and then passing pins 716 through apertures 720 in the upper end of channels 712, and matching notches 722 or other aligned apertures on legs 706, 708, 710. Ground engaging foot members 724 are also provided on the outer ends of legs 706, 708, 710, and the legs each include handhold areas 726 to facilitate gripping, carrying and pivoting the legs during setup and storage of reflector housing 780.

In addition, each of touchpad units 702, training domes 750, and reflector units 780 preferably also includes at least one hook or tab member 790 near the lower end of the cylindrical housing 704 or outer member 756 and 786, respectively. Members 790 are preferably formed of or include a magnetically attractive material, and are used during setup of the components of the system to connect a measuring cord or the like between the several system components to more easily calculate the distances between such components and to ensure that such distances are correct or uniform as may be desired. Such feature is particularly useful where the field or ground surface on which the system is being deployed does not include any delimiting markings such as commonly found on a football field or the like.

While the components of the multi-functional training system of the present invention has been described herein with respect to two possible structural configurations, it will be understood that other configurations may also be utilized without departing from the intended scope of the invention. For example, while handheld control unit 300 is shown having a particular configuration, as an alternative to having a number of different buttons representing the different modes, domes, players and queues, such items could be displayed in an menu style on the display screen for selection, and the control unit in such case many have a significantly fewer number of input buttons. As another alternative, rather than having a separate reflector unit that must be aligned with the coupled light beam emitter/detector in the training domes, the detectors could be mounted in the reflector units, or reflection type sensors that receiving reflected light from the athlete's body as he or she passes through the light beam, rather than recording the lack of such a reflection from the reflection unit, in which case the reflection units would not be required. It is therefore possible to employ different types of sensors such electromagnetic sensors and ultrasonic sensors designed to detect physical movements or motions.

Also, while the present invention has been described in a form particularly related to football where sudden starts and abrupt changes in direction at maximum output of physical energy are particularly applicable, it should be understood that the multifunctional capability of the invention can be used in many instances for other sports training as well.

While the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention

The invention claimed is:

1. A multi-functional training system comprising:

a handheld control unit for initializing, programming and selecting between different modes of operation of said training system, including at least a REACTION mode, a PATTERN mode, and a SPLIT mode, and a plurality of cue methods for each mode, including at least MANUAL VISUAL, MANUAL V & A, CADENCE, and PAD cue methods;

at least one training dome capable of bi-directional communication with said control unit, said training dome having a vertically adjustable housing section, a light beam emitter/detector pair for emitting and receiving an optical beam, an LED light means, a display screen, a timer unit, and a manually operated switch for deactivating said timer; and a touchpad unit capable of communicating with said control unit and having a push button switch adapted to cause an infrared signal to be released and an audible sound to be emitted when said switch is released.

2. The multi-functional training system of claim 1 additionally comprising at least one reflector unit adapted to be aligned in a spaced apart relationship with each of said training domes, and having a reflector means for reflecting said emitted optical beams for detection by said detector.

3. The multi-functional training system of claim 1 in which said system can be utilized in different modes to test an athlete's reaction time, to practice specific patterns, or to record sprint/split times.

4. The multi-functional training system of claim 1 in which said touchpad unit is vertically adjustable and includes a translucent or transparent housing section, and a cap that serves as the push button switch for transmitting said infrared signal.

5. The multi-functional training system of claim 4 in which said training dome is comprised of vertically adjustable inner and outer tubular members, said manually operated switch is provided on the upper surface of said inner tubular member, said LED light means and display screen are provided on the side surface of the inner tubular member.

6. The multi-functional training system of claim 5 in which said at least one training dome and touchpad unit have a plurality of leg members which are pivotable between a use position and a storage position.

7. The multi-functional training system of claim 2 in which said reflector unit is vertically adjustable.

8. The multi-functional training system of claim 7 in which said at least one training dome, touchpad unit, and reflector unit each includes at least one hook member on its lower end, which hook member is comprised of a magnetic material to facilitate securing a measuring device between the components during system setup.

9. A method of training an athlete using a multi-functional training system having a plurality of components including at least one training dome and a touchpad unit comprising the steps of:

(a) selecting a desired exercise operational mode, wherein a REACTION mode is selected;

(b) positioning the components of said system on a training location according to the requirements of said desired operational mode, whereby said at least one training dome is positioned a measured distance from said touchpad unit;

(c) ensuring that the vertical height of said at least one training dome is properly adjusted;

(d) establishing bi-directional radio frequency communication between said at least one training dome and a control unit, including applying power to the control unit and at least one training dome, and programming the addresses of each of said at least one training dome to enable the control unit to uniquely communicate with each of said domes at said addresses;

(e) using the control unit, selecting at least one training dome and receiving confirmation that said dome was selected;

(f) selecting the number of players; and (g) selecting the type of cue method by which said players will be prompted to perform the training program, whereby the type of cue method is selected from the set of cue methods containing MANUAL VISUAL, MANUAL V & A, CADENCE, and PAD.

10. The method of claim 9 wherein in step (a) a SPLIT operational mode is selected, wherein in step (b) the training domes are aligned in a straight line and positioned an equal measured distance apart from each other, and the first training dome in such set of aligned training domes is positioned the same distance from the touchpad unit, and in addition infrared reflectors are positioned opposite and equidistant from each of the respective training domes, aligned with an infrared emitter, forming a running lane between the aligned training domes and aligned infrared reflectors, with said touchpad unit if used positioned in the center of said running lane.

11. The method of claim 9 comprising the additional steps of;

(h) selecting the MANUAL VISUAL cue, causing a "start timer" and "light LED" command to be sent to the selected training dome, after which the LED on said training dome is illuminated and an internal time is started, providing a visual signal to the player to commence said training program; and (i) said athlete proceeding to the illuminated dome as quickly as possible and depressing a switch to stop said internal timer, which time increment between the "start time" and depression of said switch is recorded and defined as the reaction time.

12. The method of claim 11 comprising the additional step of:

(j) after a reaction time test is completed, commencing another reaction time test by repeating steps (f) to (h) or resetting the control unit by activating a RESET switch.

13. The method of claim 9 comprising the additional step of:

(h) selecting the MANUAL V&A cue, causing "start timer", "light LED", and "audible signal" commands to be sent to the selected training dome, after which the LED on said training dome is illuminated, an internal time is started, and an audible signal is emitted to provide both a visual and audible signal to the athlete to commence said training program; and (i) said athlete proceeding to the illuminated dome as quickly as possible and depressing a switch to stop said internal timer, which time increment between the "start time" and depression of said switch is recorded and defined as the reaction time.

14. The method of claim 13 wherein after a reaction time test is completed, commencing another reaction time event by repeating steps (f) to (i) again selecting one of the cue methods, or resetting the control unit by activating a RESET switch.

15. The method of claim 9 comprising the additional steps of:

(h) selecting the CADENCE cue, producing an audible start cadence and at the end of said cadence sending a "start timer" signal and "light LED" command to the selected training dome and providing an audible and visual signal to the player to proceed to the illuminated dome and depress a switch to stop said timer, and the time increment between the "start time" and depression of said switch being recorded and defined as the reaction time; and (i) if desired commencing another reaction time event by repeating steps (f) to (g) again selecting one of the cue methods, or resetting the control unit by activating a RESET switch.

16. The method of claim 9 additionally comprising the steps of:

(h) selecting the PAD cue, and the athlete depressing a switch on said touchpad unit, activating an infrared diode to commence an infrared transmission to said control unit, and producing an audible sound to audibly inform the athlete to begin the training event, wherein when said athlete release said switch the infrared signal terminates and causes a "start timer" and "light LED" command to be sent to the selected training dome, providing a visual signal to the player to proceed to the illuminated dome and depress a switch to stop said timer, and the time increment between the "start time" and depression of said switch being recorded and defined as the reaction time.

17. The method of claim 9 wherein in step (a) a PATTERN operational mode is selected, and wherein in step (b) one to four training domes are positioned on the field a measured distance from the touchpad unit and each other, and comprising the additional steps of:

in step (e), selecting a training dome and a number to be displayed by the selected dome using the control unit, which data is transmitted to and stored by the selected dome, and repeating step (e) by selecting other training domes and transmitting number information to said other selected training domes; and in step (g), selecting the type of cue method from the set of cue methods containing MANUAL VISUAL, MANUAL V & A, CADENCE, and PAD by activating the appropriate cue switch;

(h) displaying the number on the training dome LED display;

(i) completing the selected drill; and (j) if desired, repeating the drill by operating the AGAIN switch on the control unit.

18. The method of claim 10 wherein the SPLIT operational mode is selected, and comprising the additional steps of:

in step (g) using the control unit to send a signal to each of the desired one of said training domes to activate an infrared transmitter;

after step (e) but before step (g), operating the control unit to poll each of said selected training domes for proper alignment with their respective reflectors by sequentially sending an alignment command;

in step (i) selecting the type of cue method from the set of cue methods containing MANUAL VISUAL, MANUAL V & A, CADENCE, and PAD by activating the appropriate cue switch;

(j) upon occurrence of the selected cue method, the athlete completing the training drill by running down the running lane as quickly as possible, and the time increment between the "start time" and the player passing through and interrupting the infrared beam of each training dome reflector pair being detected by the microcontroller of each training dome and stopping its timer, and (k) polling each training dome for its respective timer value, and recording the split times.

* * * * *